US006873118B2

(12) United States Patent
Russ et al.

(10) Patent No.: US 6,873,118 B2
(45) Date of Patent: Mar. 29, 2005

(54) FIELD EMISSION CATHODE STRUCTURE USING PERFORATED GATE

(75) Inventors: Benjamin Edward Russ, San Diego, CA (US); Jack Barger, San Diego, CA (US); James Wang, San Diego, CA (US)

(73) Assignees: Sony Corporation, Tokyo (JP); Sony Electronics Inc., Park Ridge, NJ (US)

( * ) Notice: Subject to any disclaimer, the term of this patent is extended or adjusted under 35 U.S.C. 154(b) by 145 days.

(21) Appl. No.: 10/305,559

(22) Filed: Nov. 27, 2002

(65) Prior Publication Data

US 2003/0193297 A1 Oct. 16, 2003

Related U.S. Application Data

(60) Provisional application No. 60/372,853, filed on Apr. 16, 2002.

(51) Int. Cl.[7] ..... G09G 3/10

(52) U.S. Cl. ..... 315/169.3; 345/76

(58) Field of Search ..... 315/169.3, 169.4, 315/169.2, 169.1; 345/76, 77; 313/495, 422; G09G 3/10

(56) References Cited

U.S. PATENT DOCUMENTS

| | | | |
|---|---|---|---|
| 3,665,241 | A | 5/1972 | Spindt et al. |
| 4,857,161 | A | 8/1989 | Borel |
| 4,940,916 | A | 7/1990 | Borel |
| 5,019,003 | A | 5/1991 | Chason |
| 5,053,673 | A | 10/1991 | Tomii et al. |
| 5,063,327 | A | 11/1991 | Brodie et al. |

(Continued)

OTHER PUBLICATIONS

U.S. Appl. No. 10/305,527, filed Nov. 27, 2002, Russ et al.

U.S. Appl. No. 10/350,661, filed Jan. 24, 2003, Wang et al.

Candescent Technologies, *ThinCRT Showcase*, http://www.candescent.com/Candescent/showcase.htm, Jan. 16, 2001, pp. 1–4. Candescent Technologies Corporation.

Candescent Technologies, *ThinCRT Technology*, http://www.candescent.com/Candescent/tcrttch.htm, Jan. 16, 2001, pp. 1–3, Candescent Technologies Corporation.

(Continued)

*Primary Examiner*—Don Wong
*Assistant Examiner*—Trinh Vo Dinh

(74) *Attorney, Agent, or Firm*—Thomas F. Lebens; Fitch, Even, Tabin & Flannery

(57) ABSTRACT

An electron emitting structure that produces a substantially uniform electric field resulting in a substantially straight electron emission. In a preferred form, the electron emitting structure is used as a cathode plate of a field emission display (FED). In one embodiment, an electron emitting structure comprises a substrate, a first electrode formed on the substrate, a second electrode crossing over an active region of the first electrode, and an insulating material separating and electrically insulating the first and second electrodes. A plurality of openings are formed in at least a portion of the second electrode crossing over the active region. And, an electron emitting material is deposited on at least a portion of the active region of the first electrode, portions of the electron emitting material not underneath respective ones of the plurality of openings of the second electrode.

31 Claims, 15 Drawing Sheets

U.S. PATENT DOCUMENTS 5,216,324 A 6/1993 Curtin
5,245,247 A 9/1993 Hosogi
5,340,997 A 8/1994 Kuo
5,448,133 A 9/1995 Ise
5,508,584 A 4/1996 Tsai et al.
5,528,103 A 6/1996 Spindt et al.
5,548,185 A 8/1996 Kumar et al.
5,556,316 A 9/1996 Taylor et al. ..... 445/50
5,565,742 A 10/1996 Shichao et al.
5,614,785 A 3/1997 Wallace
5,619,097 A 4/1997 Jones
5,649,847 A 7/1997 Haven
5,689,151 A 11/1997 Wallace
5,773,921 A 6/1998 Keesmann et al.
5,811,926 A 9/1998 Novich
5,834,891 A 11/1998 Novich
5,880,554 A 3/1999 Liu ..... 313/309
5,910,704 A 6/1999 Choo
5,949,394 A * 9/1999 Kishino et al. ..... 345/74.1
5,962,959 A 10/1999 Iwasaki et al. ..... 313/310
5,986,390 A 11/1999 Chuman et al. ..... 313/310
6,031,328 A 2/2000 Nakamoto
6,039,622 A 3/2000 Kosaka et al.
6,064,148 A 5/2000 Tolt et al.
6,066,922 A 5/2000 Iwasaki et al. ..... 315/169.3
6,094,001 A 7/2000 Xie
6,097,138 A 8/2000 Nakamoto
6,144,144 A 11/2000 Cleeves et al.
6,146,230 A 11/2000 Kim et al.
6,149,484 A 11/2000 Amrine et al.
6,153,969 A 11/2000 Levine
6,323,831 B1 11/2001 Ono et al.
6,359,383 B1 3/2002 Chuang et al.
6,377,002 B1 4/2002 Ge et al.
6,489,710 B1 * 12/2002 Okita et al. ..... 313/309
6,509,677 B2 1/2003 Xia et al.
6,515,429 B2 2/2003 Russ et al.
6,559,602 B2 5/2003 Russ et al.
6,590,320 B1 7/2003 Abanshin et al. ..... 313/309
6,650,061 B1 11/2003 Urayama
2001/0028215 A1 10/2001 Kim
2002/0030438 A1 * 3/2002 Ito et al. ..... 313/495
2002/0036460 A1 * 3/2002 Takenaka et al. ..... 313/495
2002/0047559 A1 4/2002 Frayssinet et al. ..... 315/169.3
2002/0185950 A1 12/2002 Russ et al.
2002/0185951 A1 12/2002 Russ et al.
2002/0185964 A1 12/2002 Russ et al.
2002/0187706 A1 12/2002 Russ et al.
2002/0187707 A1 12/2002 Russ et al.
2002/0195959 A1 12/2002 Russ et al.

OTHER PUBLICATIONS

Candescent Technologies, *The ThinCRT Concept*, http://www.candescent.com/Candescent/tcrtcnpt.htm, Jan. 16, 2001, pp. 1–6, Candescent Technologies Corporation.

Candescent Technologies, *Candescent ThinCRT Technology Primer*, http://www.candescent.com/Candescent/techprim-.htm, Jan. 16, 2001, pp. 1–5, Candescent Technologies Corporation.

Ito et al, *Carbon–Nanotube–Based Triode–Field–Emission Displays Using Gated Emitter Structure*, IEEE Electron Device Letters, Sep. 2001, pp. 426–428, vol. 22, No. 9.

* cited by examiner

FIELD EMISSION CATHODE STRUCTURE USING PERFORATED GATE

This application claims priority under 35 U.S.C. § 119(e) to U.S. Provisional Patent Application No. 60/372,853, filed Apr. 16, 2002, of Russ, et al., for NOVEL CATHODE STRUCTURE FOR FED UTILIZING PERFORATED GATE, which U.S. Provisional patent application is incorporated herein by reference.

BACKGROUND OF THE INVENTION

1. Field of the Invention

The present invention relates generally to flat panel displays (FPDs), and more specifically to field emission displays (FEDs). Even more specifically, the present invention relates to the cathode structure of a field emission display (FED).

2. Discussion of the Related Art

A field emission display (FED) is a low power, flat cathode ray tube type display that uses a matrix-addressed cold cathode to produce light from a screen coated with phosphor materials. FIG. 1 is a cross sectional view of a conventional FED. The FED 100 includes a cathode plate 102 and an anode plate 104, which opposes the cathode plate 102. The cathode plate 102 includes a substrate 106, cathodes or base electrodes 107 printed on the substrate 106, a first dielectric layer 108 disposed on the substrate 106 and the base electrodes 107, 109, 111, and a gate electrode 114 disposed on the first dielectric layer 108 and several emitter wells 110 formed within the gate electrode 114 and the first dielectric layer 108, such that the gate electrode 114 and the first dielectric layer 108 circumscribe each emitter well 110. A conical shaped electron emitter 112, e.g., a Spindt tip, is deposited within each emitter well 110. In order to precisely align the gate electrode 114 with the emitters 112, the wells 110 are formed by etching or cutting them out of the first dielectric layer 108 and the gate electrode 114 then depositing an emitter 112 within each well 110.

The anode plate 104 includes a transparent substrate 116 upon which is formed an anode 118. Various phosphors are formed on the anode 118 and oppose the respective emitters 112, for example, a red phosphor 120, a green phosphor 122 and a blue phosphor 124.

It is important in FEDs that the particle emitting surface of the cathode plate 102 and the opposed anode plate 104 be maintained insulated from one another at a relatively small, but uniform distance from one another throughout the full extent of the display face in order to prevent electrical breakdown between the cathode plate and the anode plate, provide a desired thinness, and to provide uniform resolution and brightness. Additionally, in order to allow free flow of electrons from the cathode plate 102 to the phosphors and to prevent chemical contamination, the cathode plate 102 and the anode plate 104 are sealed within a vacuum. In order to maintain the desired uniform separation between the cathode plate 102 and the anode plate 104 across the dimensions of the FED, structurally rigid spacers (not shown) are positioned between the cathode plate 102 and the anode plate 104.

The FED 100 operates by selectively applying a voltage potential between a respective one or more of the base electrodes 107, 109, 111 and the gate electrode 114, producing an electric field focused to cause a selective emission from the tips of the emitters 112. FIG. 2 illustrates an electric field 202 produced, which focuses on the tip of the emitter 112 in order to cause the electron emission 204. The emitted electrons are accelerated toward and illuminate respective phosphors of the anode 118 by applying a proper potential to the anode 118.

In another conventional FED illustrated in FIG. 3, an FED 300 further includes a second dielectric layer 302 disposed upon the gate electrode 114 and a focusing electrode 304 disposed upon the second dielectric layer 302. In operation, a potential is also applied to the focusing electrode 304 to collimate the electron emission from respective emitters 112. Thus, the focusing electrode 304 concentrates the electrons to better illuminate a single phosphor and to reduce the spread of electrons, this spread illustrated in the emission 204 of FIG. 2.

FIG. 4 illustrates yet another conventional FED design. In this design of the FED 400, multiple emitters 112 are deposited within wells 110 over each base electrode, e.g., base electrode 107. In operation, the electron emission from each of the emitters 112 on a given base electrode, e.g., base electrode 107, is directed toward a single phosphor, e.g., phosphor 120. Since the emission isn't focused, the phosphor 120 is slightly oversized relative to the base electrode 107 such that only the intended phosphor is illuminated.

FIG. 5 illustrates a cut-away perspective view of the conventional FED 400 of FIG. 4. As shown, the gate electrode 114 and the first dielectric layer 108 form a grid in which the generally circular-shaped emitter wells 110 are formed. In fabrication, the cathode substrate 106 is screen printed with the base electrodes 107, 109, 111 (electrode 107 is illustrated). Next, the first dielectric layer 108 is formed over the substrate 106 and the respective base electrodes 107, 109, 111. A gate electrode layer is applied over the first dielectric layer 108. The wells 110 and gate electrode 114 are formed by etching the first dielectric layer 108 and the gate electrode layer. Then, an emitter 112 is deposited into each well 110.

SUMMARY OF THE INVENTION

The invention provides an electron emitting structure that produces a substantially uniform electric field resulting in a substantially straight electron emission. In a preferred form, the electron emitting structure is used as a cathode plate of a field emission display (FED), which advantageously, does not require a separate focusing structure.

In one embodiment, the invention can be characterized as an electron emitting structure comprising: a substrate; a first electrode formed on the substrate; a second electrode crossing over an active region of the first electrode; an insulating material separating a portion of the first electrode and a portion of the second electrode and electrically insulating the first electrode from the second electrode; a plurality of openings formed in at least a portion of the second electrode crossing over the active region; and an electron emitting material deposited on at least a portion of the active region of the first electrode, portions of the electron emitting material not underneath respective ones of the plurality of openings of the second electrode.

In another embodiment, the invention can be characterized as a method of electron emission comprising the steps of: applying a first potential to a first electrode formed on a substrate of an electron emitting structure; applying a second potential to a second electrode crossing over an active region of the first electrode, the second electrode electrically insulated from the first electrode, the first electrode and the second electrode separated and electrically insulated from each other, wherein a plurality of openings are formed in at least a portion of the second electrode that crosses over the active region; producing an electric field across the active region as a result of the applying the first potential and the applying the second potential; and causing, as a result of the producing step, an electron emission from an electron emitting material located on the active region, wherein portions of the electron emission pass through respective ones of the plurality of openings and portions of the electron emission are blocked by the second electrode.

In a further embodiment, the invention may be characterized as a field emission display comprising a cathode plate and an anode plate. The cathode plate comprising: a substrate; base electrodes formed on the substrate, the base electrodes functioning as cathodes; gate electrodes crossing over the base electrodes, wherein each gate electrode crosses over an active sub-pixel region of each base electrode; an insulating material separating portions of the base electrodes and portions of the gate electrodes and electrically insulating the base electrodes from the gate electrodes; a plurality of openings formed in at least a portion of each gate electrode crossing over a respective active sub-pixel region of a respective base electrode; and an electron emitting material deposited on at least a portion of the active sub-pixel regions of the base electrodes, portions of the electric emitting material not underneath respective ones of the plurality of openings of the gate electrodes. The anode plate comprising: a transparent substrate separated above the substrate; and phosphor material coupled to the transparent substrate, portions of the phosphor material corresponding to active sub-pixel regions of the base electrodes.

BRIEF DESCRIPTION OF THE DRAWINGS

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION

The following description is not to be taken in a limiting sense, but is made merely for the purpose of describing the general principles of the preferred embodiments. The scope of the invention should be determined with reference to the claims.

According to several embodiments of the invention, an electron emitting structure is provided that produces a substantially uniform electric field resulting in a substantially straight electron emission. In a preferred form, the electron emitting structure is used as a cathode plate of a field emission display (FED), which advantageously, does not require a separate focusing structure. An electron emitting structure is provided which includes linear base electrodes (also referred to as cathode lines) formed across a substrate and linear gate electrodes crossing over the linear base electrodes. The gate electrodes are separated from the base electrodes by a dielectric or insulating material that is formed over the substrate and optionally over portions of the base electrodes, such that portions of the gate electrodes contact the insulating material.

Active regions of the base electrodes are defined as regions of the base electrodes where an electron emitting material may be deposited. For example, in one embodiment, an active region of the base electrode is defined as the region of the base electrode directly underneath a portion of a gate electrode crossing thereover. Additionally, at least a portion of the portion of the gate electrode crossing over the base electrode includes a plurality of openings formed therein. An emitter material (e.g., several emitter portions, tips or nanotubes or a continuously deposited emitter material) is deposited on each active region. Alternatively, the emitter material is applied throughout each base electrode, such that the emitter material does not break in between adjacent active regions of the base electrodes. In preferred embodiments in use as a cathode plate of a field emission display, the active regions of the base electrodes may be referred to as cathode sub-pixel regions, each cathode sub-pixel region corresponding to a sub-pixel of the display device.

Each active region is driven by applying an appropriate voltage to a respective base electrode and applying an appropriate voltage to a gate electrode crossing over a respective active region of the respective base electrode. A substantially uniform electric field is produced across the active region, which is sufficient to cause a substantially straight electron emission from the active region. Portions of the electron emission pass through respective ones of the openings formed in the gate electrode thereabove, while other portions of the electron emission are blocked or intercepted by portions of the gate electrode.

Figure 6:
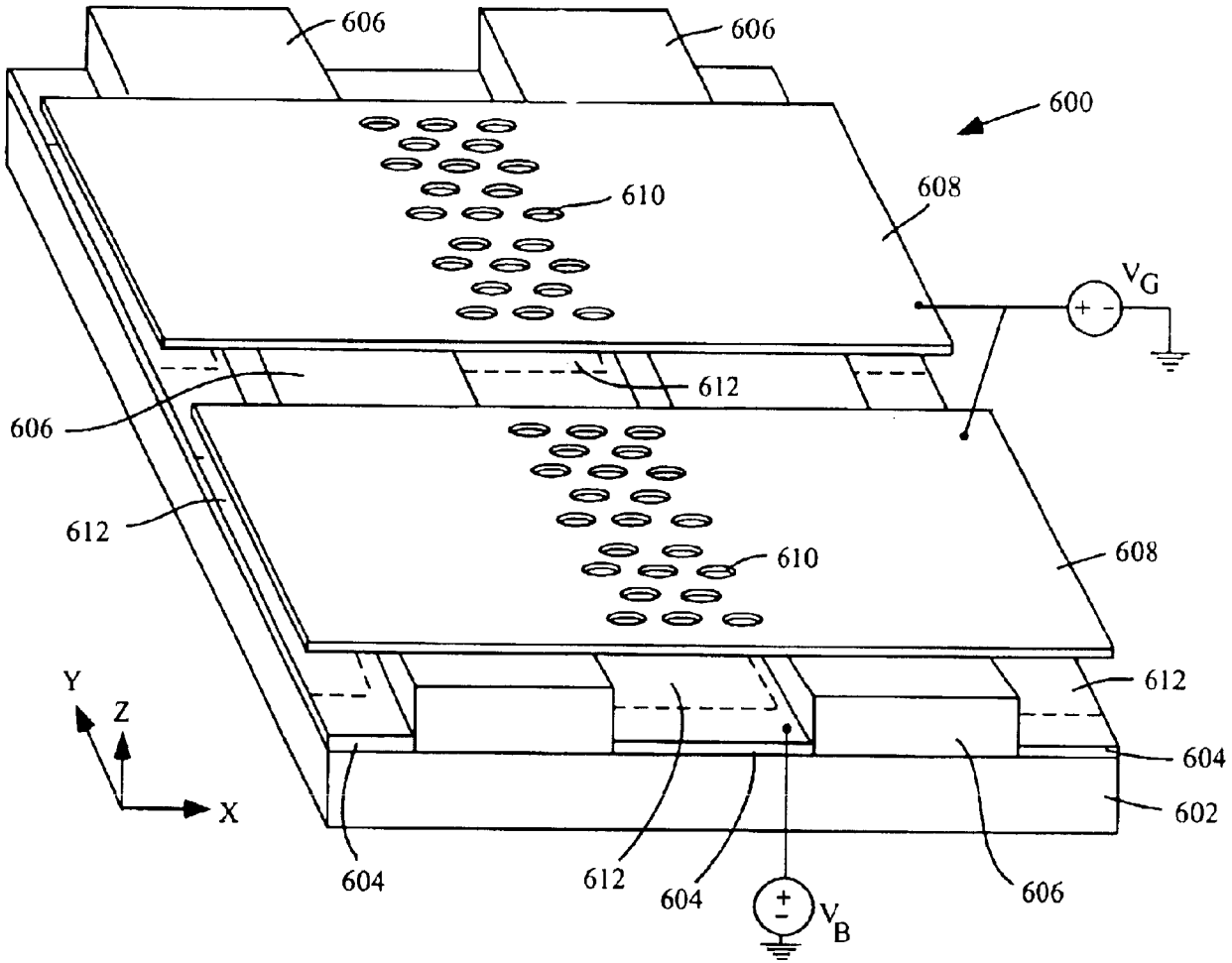
FIG. 6 is a perspective view of a portion of an electron emitting structure used for example, as a cathode plate of a field emission display (FED), in accordance with the present invention including gate electrodes crossing over base electrodes formed on a substrate and separated from the gate electrodes by an insulating material formed on the substrate, each gate electrode having openings formed therein.
Figure 7:
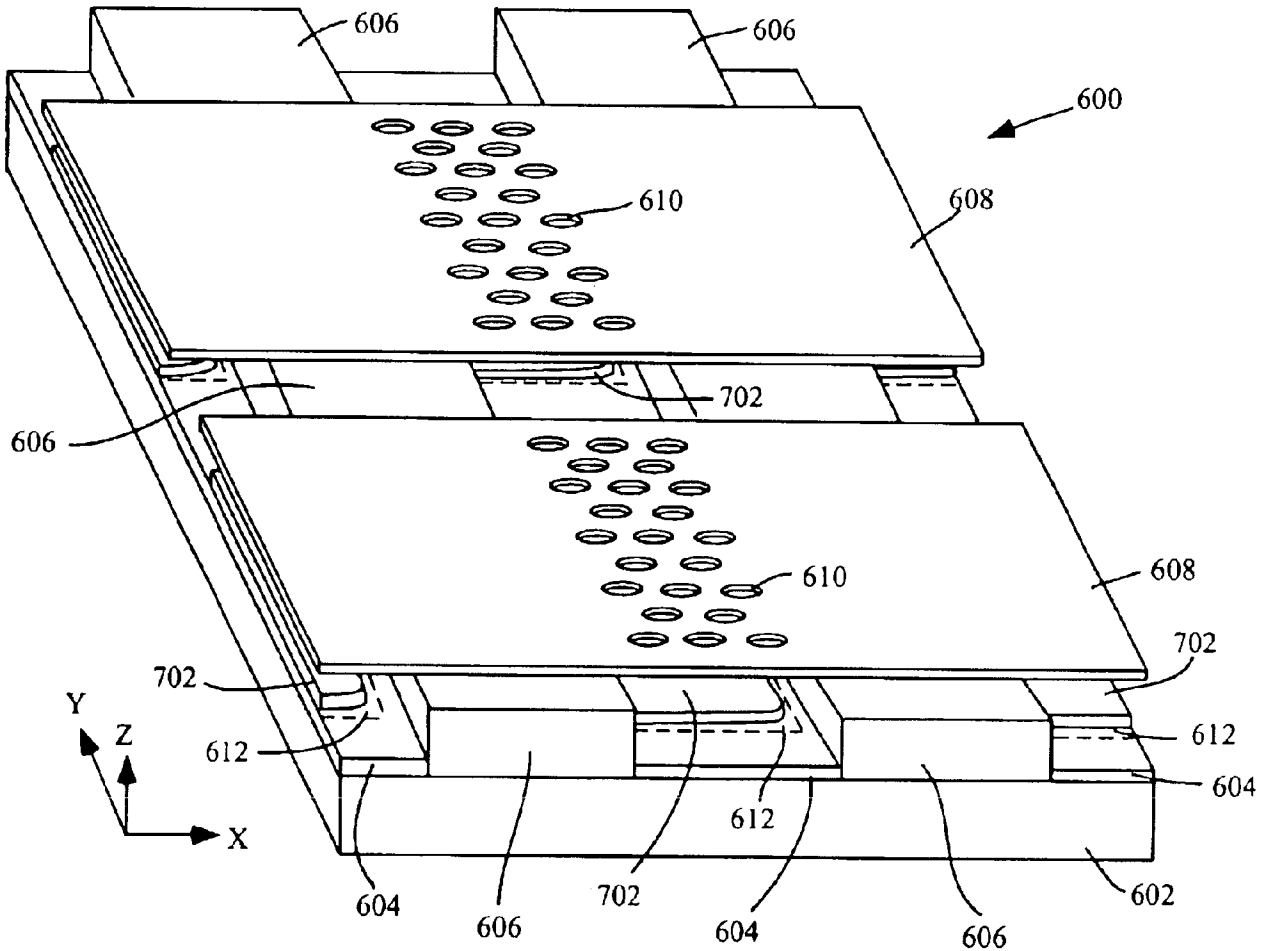
FIG. 7 is a perspective view of the electron emitting structure of FIG. 6 including electron emitting material deposited on active regions of the base electrodes.

Referring first to FIGS. 6 and 7, perspective views are shown of a portion of an electron emitting structure, used for example as a cathode plate of a field emission display (FED), in accordance with the present invention. Illustrated is the electron emitting structure 600 or plate including a substrate 602, base electrodes 604 (also referred to as cathodes of an FED and referred to generically as first electrodes) printed on the substrate 602, and gate electrodes 608 (also referred to as gates of an FED and referred to generically as second electrodes) crossing over the base electrodes 604. The base electrodes 604 are embodied as lines of conductive metallic material. The gate electrodes 608 are separated from the base electrodes 604 by an insulating material, which is embodied as insulating members 606 (also referred to as ribs, barriers or lines) of a dielectric material formed over the substrate 602. Preferably, the insulating members 606 are linear ribs that are formed in between adjacent linear base electrodes 604. It should be understood that the insulating material may take on many alternative geometries than the illustrated linear insulating members 606. The gate electrodes 608 cross over the insulating material and the base electrodes 604 while contacting the insulating material. The gate electrodes 608 are preferably embodied as ribbons or lines of conductive material. Additionally, a portion of each gate electrode 608 crossing over a respective base electrode 604 includes a plurality of openings 610 (also referred to as holes or perforations) formed therein such that at least a portion of each gate electrode 608 is perforated or forms a mesh. Active regions 612 of the base electrode are those regions of the base electrode that an electron emitting material may be deposited.

As illustrated, preferably, the base electrodes 604 extend substantially parallel to each other across the substrate 602. In preferred form, the base electrodes 606 form rows extending across the substrate 602. The linear insulating members 606 extend across the substrate 602 substantially parallel to each other and formed in between respective base electrodes 604. Thus, according to one embodiment, the linear insulating members 606 resemble linear ribs, barriers or ridges of dielectric material formed in between linear base electrodes 604.

Figure 17:
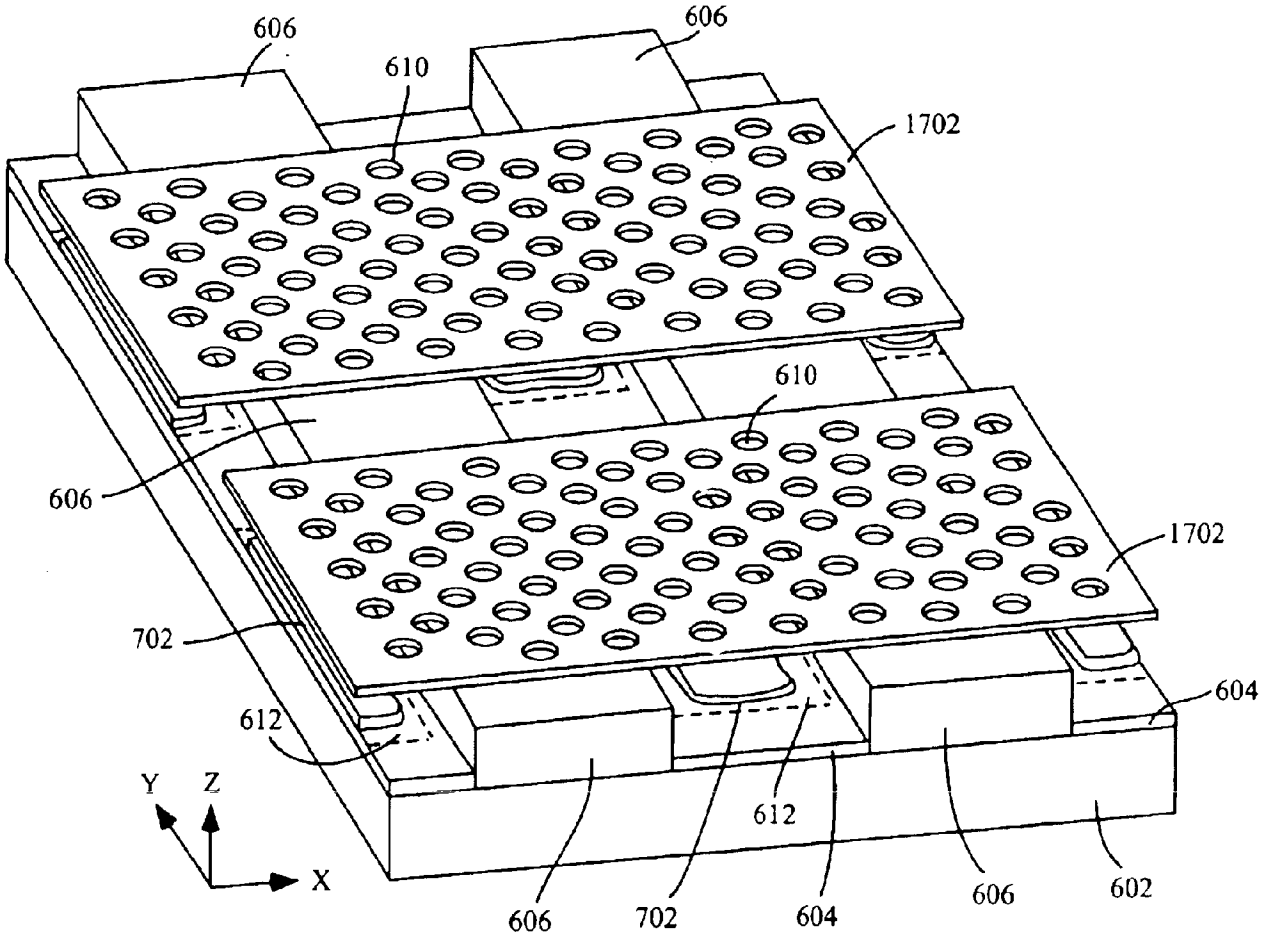
FIG. 17 is a perspective view of an alternative embodiment of the electron emitting structure of FIG. 6 in which the openings formed in the gate electrode extend in between active regions.

In this embodiment, each gate electrode 608 is a conductive material formed to cross over the base electrodes 604 and the insulating members 606 while contacting an upper surface of the insulating members 606. The gate electrodes 608 may be formed over the insulating members 606 or separately formed or manufactured, then positioned over and across the insulating members 606. Preferably, the gate electrodes 608 run generally perpendicular to the base electrodes 604 and the insulating members 606. The openings 610 are formed in at least a portion of the gate electrode 608 that crosses over a respective base electrode 604. For example, as illustrated, the openings 610 are formed in a portion of each gate electrode 608 that cross over the active region 612 of each base electrode 604. However, it is understood that the openings 610 may be formed over other portions (e.g., an entire gate electrode such as illustrated in FIG. 17) of each gate electrode 608 such that some of the openings 610 are positioned over respective ones of the insulating members 606. The openings 610 may take on a variety of shapes, e.g., circles, ovals, squares, rectangles, triangles, pentagons, stars, etc. However, the exact shape of the openings 610 is not as important as its function of allowing portions of an electron emission to pass therethrough, while at the same time blocking other portions of an electron emission. It is noted that generally and in contrast to the known emitter in well designs, in preferred embodiments, there is no dielectric or insulating material positioned underneath the portion of the gate electrode 608 crossing over the active region 612. In other words, an insulating material does not separate the base electrode and the gate electrode in the active region 612 such that it circumscribes each opening 610. The significance of this feature and the openings 610 is discussed further below.

Generally, active regions 612 (also referred to as cathode sub-pixel regions in an FED) of each base electrode 604 are defined as the regions of a base electrode 604 below a portion of the gate electrode 608 crossing thereover and on which an electron emitting material may be deposited. For example, in the embodiment of FIG. 6, each active region 612 is bounded on opposite sides by adjacent insulating members 606. In the embodiment illustrated, preferably each active region 612 is a rectangular region that is bounded on one set of opposite sides by dielectric material, i.e., insulating members 606. In a preferred embodiment sized for a 21-inch FED, the active region 612 is approximately 50 $\mu$m by 150 $\mu$m. This is on contrast to the emitter well design of conventional FEDs in which each emitter well is approximately 1–10 $\mu$m in diameter and is surrounded on all sides by a dielectric material and a gate electrode. It is also noted that an entire length of a base electrode 604 may be defined as an active region depending on the embodiment, e.g., there is no break between active regions of a given base electrode.

As illustrated in FIG. 7, an electron emitting material 702 is deposited on each active region 612 of the base electrodes 604. The electron emitting material 702 may be any low work function material that easily emits electrons, for example, a carbon-based material such as carbon graphite or polycrystalline carbon. Additionally, those skilled in the art will recognize that the emitter material 702 may comprise any of a variety of emitting substances, not necessarily carbon-based materials, such as an amorphous silicon materials, for example.

In one embodiment, the emitter material 702 comprises a plurality of discrete electron emitting portions that are deposited to substantially cover the active region 612. For example, the emitter material 702 comprises many tiny emitter cones (i.e., Spindt tips) positioned closely together, such that collectively, the many emitter cones form the emitter material 702. In this embodiment, there is no dielectric material or other insulating or separating structure in between individual emitter cones on the surface of the active region. Additionally, many of the emitter cones are positioned directly under openings 610 of a given gate electrode 608, while many are positioned directly under solid portions of the given gate electrode 608. This is in contrast to the individual emitter cones located within individual emitter wells as shown in FIGS. 1–5, where no emitter 112 is positioned under a solid portion of a gate electrode such that its emission is blocked, i.e., every emitter 112 is deposited within a respective well 110. Furthermore, each emitter 112 is separated by dielectric material and gate electrode material (located in separate wells).

In some embodiments, rather than using cones or tips of emitter material, the emitter material 702 the plurality of electron emitting portions comprise single wall or multi-wall nanotubes. For example, known single wall nanotubes have a tube-like structure approximately 1–100 $\mu$m tall and 1–7 nm in diameter, while multiwall nanotubes have approximately 1–100 $\mu$m tall and 10–100 nm. Many nanotubes are deposited on each active region 612. In the embodiment where an active region is sized 50×150 $\mu$m, several hundred nanotubes may be deposited on a given active region 612. Preferably, the nanotubes are spaced about 1–2 $\mu$m apart such that the height to spacing ratio is about 1:2. It has been found that in some embodiments, if the nanotubes are positioned too close together, the nanotubes shield the electric field, thus, reducing the electric field at the emitting surface.

It is noted it is not required that the spacing between nanotubes or emitter cones, or other pieces of discrete emitter portions be consistent. For example, many emitting portions may be spaced optimally apart (1:2 height to spacing ratio) as described above; however, many may be spaced closer than optimal. Thus, advantageously, the emitter material may be deposited in a relatively random pattern such that the emitter material substantially covers the active region 612.

It is noted that while in preferred embodiments, the active region 612 is sized for a 21-inch FED display (i.e., the active region 612 in one embodiment is 50×150 $\mu$m), the active regions may be scaled to any desired dimensions. However, in preferred embodiments, the active region 612 should be large enough to allow at least one discrete electron emitting portion, e.g., tips, cones, pyramids, nanotubes, etc., to be deposited thereon, the individual emitter portions not separated by gate electrode material or dielectric material therebetween. For example, the width of the active region (i.e., the distance between adjacent insulating members 606 should be at least 10 $\mu$m, preferably at least 20 $\mu$m and most preferably at least 30 $\mu$m, while the length may be varied depending on the size of the pixel and display desired.

Furthermore, in some embodiments, rather than comprising a plurality of discrete electron emitting portions, the electron emitting material 702 comprises a layer or thin film of emitting material that is applied to at least a portion of the active regions 612. That is, the electron emitting material 702 is a continuous nanocrystalline film layer (e.g., a powder or a molten liquid that hardens) substantially covering the active region 612. This continuous layer is preferably deposited to have a substantially uniform depth across the active region. This is a departure from the known tip emitter within well design since the emitter material is spread out over a larger area and additionally lacks a distinct tip or focal point for the electric field, i.e., the depth of the tip emitter varies dramatically from base to tip to base. Furthermore, since there is preferably no (or little) insulating material between the portion of the gate electrode 608 crossing over the active region 612, more emitter material may be deposited on the active region 612.

Additionally, the layer of emitting material may be continuously deposited across at least a portion of the width of the active region 612 and along at least a portion of the length of the base electrode 604. In other words, the active region and the emitter material layer extend continuously along the length of the base electrode 604 without breaking in between adjacent gate electrodes 608 crossing thereover. As such, there is one continuous active region formed along the base electrode 604, rather than discrete active regions 612 as illustrated in FIG. 6.

Additionally, the emitter material 702 is preferably substantially uniformly deposited as a smooth layer having a relatively constant thickness, depth or height on the active region 612, which in some embodiments is helpful in producing a substantially uniform electron emission. In another embodiment, the emitter material 702 may be made such that it has an uneven height, or has bumps, throughout the active region 612.

In the embodiment of the FIGS. 6–7, the active regions 612 are bounded on opposite sides by dielectric material, e.g., linear insulating members 606. However, it is noted that alternatively, each active region 612 may be bounded on all sides by a dielectric material. For example, the insulating members 606 may extend in between the base electrodes 604 as illustrated and also have portions that extend parallel to and in between the gate electrodes 608, without substantively affecting the electric field or the resulting emission from the active region 612. In this alternative embodiment, the active region 612 is still defined by the portion of the gate electrode directly crossing over the base electrode 604.

In yet another embodiment, the active region may be segmented into smaller portions, for example, by one or more ribs of dielectric material extending across the active region 612. Again, each divided active sub-region is preferably large enough to allow one or more discrete electron emitting portions or a continuously applied material deposited thereon and does not substantially affect the generated electric field. Thus, generally, in the embodiment of the FIGS. 6–7, there is no insulating material separating the base electrode 604 from the gate electrode 608 in the active regions 612. However, it is noted that alternatively, there may be some amount of insulating material positioned on the active region of the base electrode 608 and separating a portion of the gate electrode 608 from a portion of the active region of the base electrode 604. However, the lack of insulating material assists in providing a substantially uniform electric field. Furthermore, emitter material is still positioned under portions of the gate electrode that block the emission.

In operation, each base electrode 604 is coupled to a drive voltage $V_B$, e.g., a cathode drive voltage in an FED, which is controlled via driving/addressing software. Each gate electrode 608 is coupled to a gate drive or gate voltage $V_G$, which is controlled via driving/addressing software. The driving/addressing software uses known row and column addressing and driving techniques. In order to cause an electron emission from an emitter material 702 on a respective active region 612, a voltage potential to applied to a respective base electrode 604 and a voltage potential is applied to a respective gate electrode 608. The application of appropriate potentials produces an electric field across the active region 612 that is sufficient to cause an electron emission from the emitter material 702 deposited on the active region 612. In preferred embodiments, through the selection of emitting materials, such as carbon-based nanotubes, a potential difference of approximately 20 volts between the base electrode voltage and the gate electrode voltage will result in an electric field that causes such an electron emission.

Advantageously, according to several embodiments, the base electrode 604 and the gate electric 608 are oriented in a parallel plate arrangement. A pure parallel plate arrangement produces a very uniform electric field therebetween;

however, in a field emission device, the plate opposite the emitting surface would block the resulting emission. Thus, the openings 610 are formed in the gate electrode 608 and function to allow portions of the electron emission to escape therethrough. However, not all portions of the electron emission pass through respective openings 612, many portions of the emission are blocked or intercepted by the gate electrode 608 material itself (see FIG. 13 for example). That is, portions of the electron emission pass through the gate electrode 608 and portions do not pass through the gate electrode 608. The parallel plate arrangement of the gate electrode 608 and base electrode 604 provide the substantially uniform electric field and openings 610 are included in order to provide a path for emitted electrons to escape and be collected, for example, by an anode of an FED. Thus, the electron emitting structure produces an electric field that is substantially uniform across the active region 612 such that the electron emission is substantially straight up from the emitting surface. The openings 610 are sized and positioned to allow adequate electron emission to escape while not taking away from the parallel plate arrangement of the base electrode 604 and the gate electrode 608. In preferred form, the openings allow about 33% transmission of the electron emission through the gate electrode 608. It should be understood that the openings 610 may be designed such that between 20–80% of the electron emission passes through the gate electrode 608 while still retaining a substantially uniform electric field.

Figure 1:
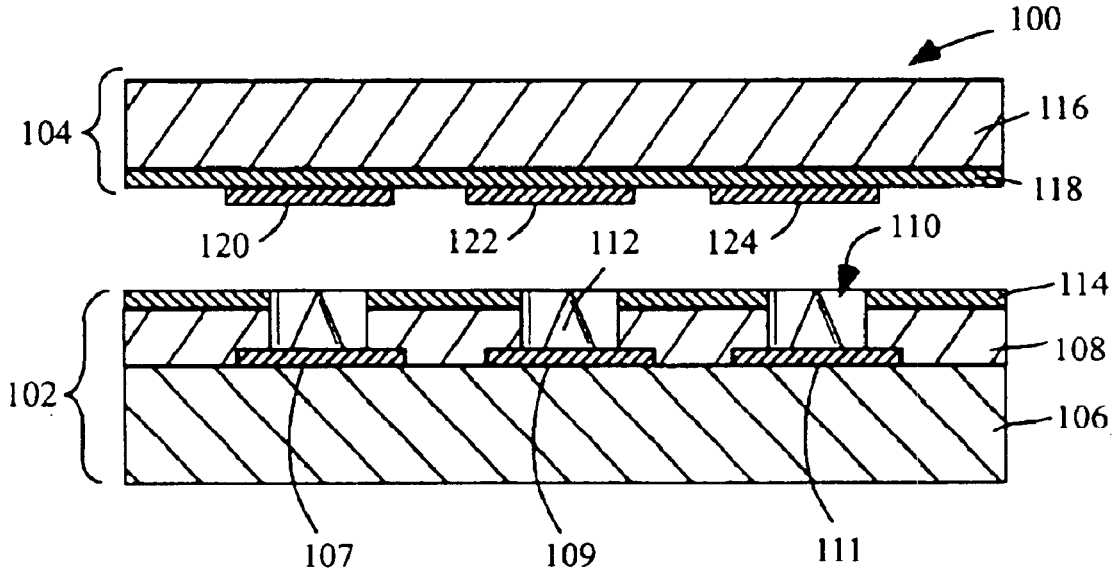
Fig. 1 (Prior Art)
FIG. 1 is a cross sectional view of a conventional field emission display (FED).
Figure 2:
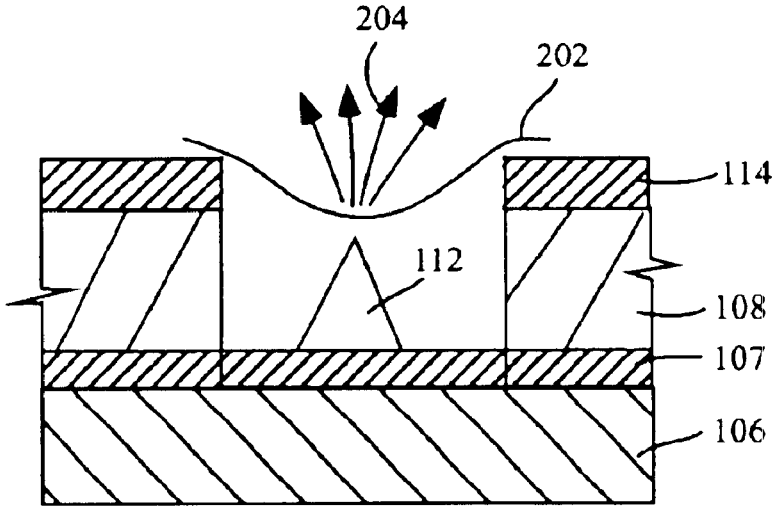
Fig. 2 (Prior Art)
FIG. 2 is a diagram of the electric field produced within a given emitter well of the conventional FED of FIG. 1.
Figure 3:
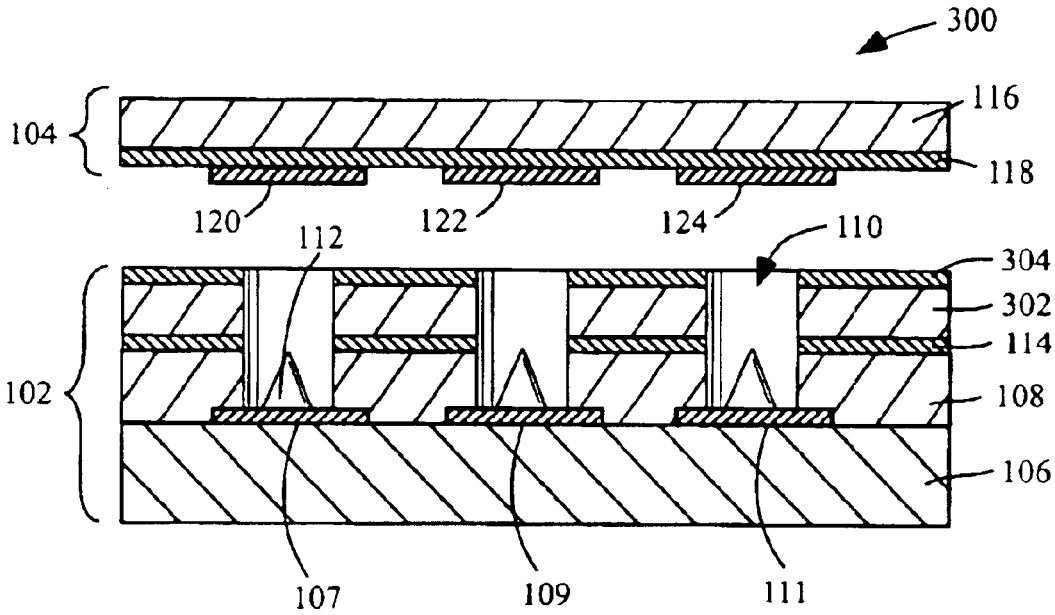
Fig. 3 (Prior Art)
FIG. 3 is a cross sectional view of a conventional FED including a focusing electrode.
Figure 4:
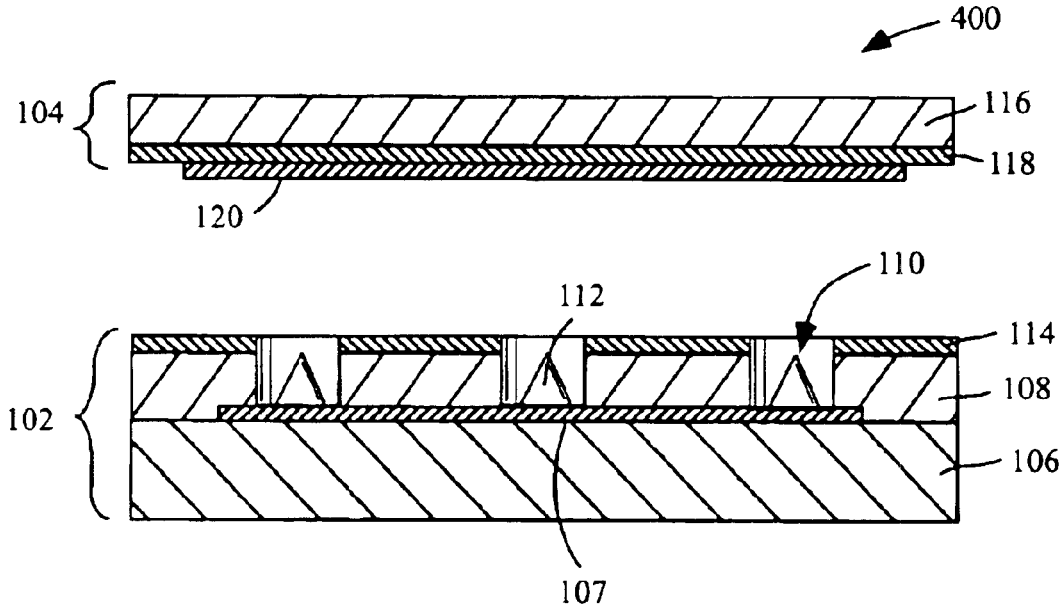
Fig. 4 (Prior Art)
FIG. 4 is a cross sectional view of another conventional FED.
Figure 5:
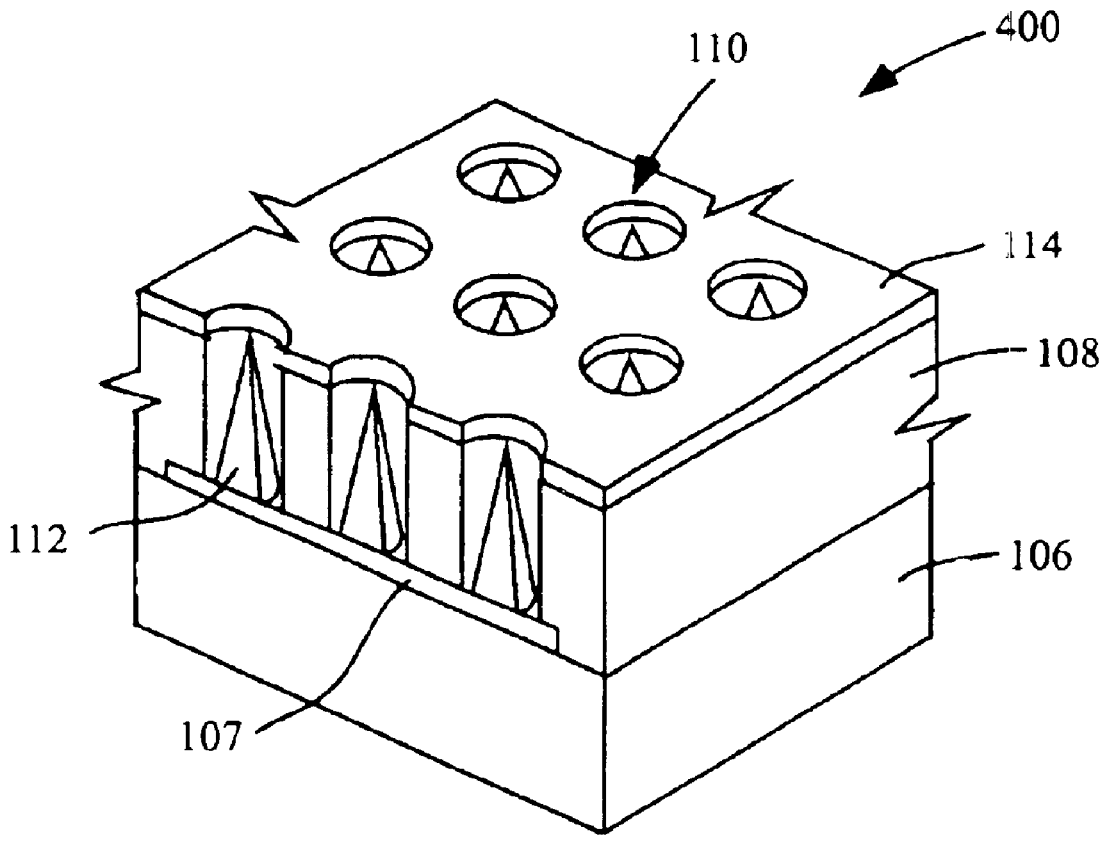
Fig. 5 (Prior Art)
FIG. 5 is a cut-away perspective view of the conventional FED of FIG. 4.

It is noted some amount of insulating material formed between the active region 612 and the gate electrode 608 crossing thereover, may be added without substantially affecting the electric field uniformity. However, the more insulating material formed in between the gate electrode and the active region, the less the base electrode and gate electrode resemble a parallel plate arrangement, which results in a less uniform electric field, and thus, an emission that may require additional focusing. The traditional emitter in well design represents an opposite extreme in which insulating material is formed between the gate and the base at all portions other than the well itself. The presence of the dielectric material causes the base and the gate to lose the parallel plate-like appearance and the resulting electric field is non-uniform, e.g., the electric field peaks in the well as illustrated in FIG. 2.

Advantageously, according to several embodiments, the electric field produced is substantially uniform across a majority of the active region, such that the resulting electron emission is substantially straight up. Thus, a focusing electrode or other focusing structure is not required in order to limit the spread of the electron emission, as is commonly required in traditional emitter in well FED designs. Additionally, due to the substantially straight emission, the phosphors of an FED are not required to be slightly oversized relative to the active regions as done in conventional FEDs that do not use a focusing structure.

The manufacture of the electron emitting structure 600 may be according to well-known semiconductor manufacturing techniques. For example, the base electrodes 604 are sputtered on the substrate 602 out of a suitable conducting material, e.g., gold, chrome, molybdenum, platinum, etc. A layer of photosensitive dielectric material, e.g., ceramic or glass, is then spin coated or formed over the substrate 602 and optionally over portions of the base electrodes 604. Next, a layer of conductive gate electrode material is formed over the layer of dielectric material. Then, the gate electrode material layer and the dielectric material layer are patterned using photolithography, for example, and etched away to form the gate electrodes 608 having the plurality of openings and crossing over the insulating members 606, as illustrated in FIG. 6. Next, the insulating material underneath the portion of the gate electrode 608 crossing over the active region that was not etched away when the openings were formed is then etched away. Next, the emitter material 702 is deposited on the active regions 612, e.g., as discrete electron emitting portions or as a continuous layer or film of emitting material.

Alternatively, rather than forming the gate electrodes 608 over the dielectric layer, the gate electrodes 608 are separately manufactured and predrilled. Thus, the dielectric layer is patterned using photolithography, for example, and etched away to form the insulating members 606 and the base electrodes 604. Next, the electron emitting material 702 is deposited on the active regions 612 of the base electrodes 604, e.g., deposited as a plurality of electron emitting portions or as a continuous layer. It is noted that the electron emitting material may be deposited continuously along the base electrode such that there is no break in electron emitting material between adjacent active regions 612 (i.e., the whole length of the base electrode defines an active region). In this embodiment, the manufacture is simpler since it is easier to deposit the electron emitting material 702 with the gate electrodes 608 not in position.

Next, the separately manufactured gate electrodes 608 are then placed and aligned in position over the insulating members 606, then tensioned and affixed, e.g., using an appropriate sealant, such as frit, or spot welding. In one embodiment, the gate electrode 608 is preformed and predrilled using known laser micromachining techniques. For example, the openings 610 may be drilled having a diameter of 10–25 $\mu$m and having a 10:1 aspect ratio (e.g., height to diameter). It is noted that in this alternative embodiment, the gate electrodes are typically thicker than in the embodiment where the gate electrode is formed as a layer over the dielectric layer. For example, a separately formed gate electrode 608 may be 25–150 $\mu$m thick (e.g., 100 $\mu$m in one embodiment), depending on the micromachining process and the materials used, in comparison to a formed gate electrode having a thickness of about 1–10 $\mu$m thick. It is noted that as laser micromachining techniques and materials improve, the thickness of the gate electrode may be made smaller. It is noted that the thicker, separately made gate electrode 608 additionally, provides an aperturing effect as the escaping electrons pass through the openings 610, although since the electric field produced is substantially uniform, the openings 610 are not needed to focus the emission.

Additionally, it is noted that separately manufactured gate electrodes are currently preferred to gate electrodes formed over a dielectric layer, since it may be difficult to completely etch out the insulating material from underneath the portion of the gate electrode 608 crossing over the base electrode 604. Thus, it is noted that many of the figures presented herein are not necessarily drawn to scale.

In a preferred embodiment, the electron emitting structure 600 is implemented as a cathode plate for an FED, e.g., a 21-inch FED. For example, the base electrodes 604 are each about 50 $\mu$m wide and about 1000 angstroms thick extending about the substrate 602, and spaced about 50 $\mu$m apart. The linear insulating members 606 are each about 50 $\mu$m wide, about 10 $\mu$m thick and spaced about 50 $\mu$m apart. Each gate electrode 608 is about 150 $\mu$m wide and about 1000 angstroms to about 100 $\mu$m thick extending across the length of at least a portion of the display and crossing over the base electrodes 604 and the insulating members 606. Adjacent gate electrodes 608 are spaced about 50 μm apart. Each active region 612 is about 50 μm in width and 150 μm in length. Furthermore, the electron emitting material 702 comprises carbon-based nanotubes having a height of about 1–3 μm and a diameter of about 1 μm, which are deposited to substantially cover at least a portion of the active region 612. It is noted that the dimensions of the various components may be altered depending on the specific implementation without departing from the invention.

Figure 8:
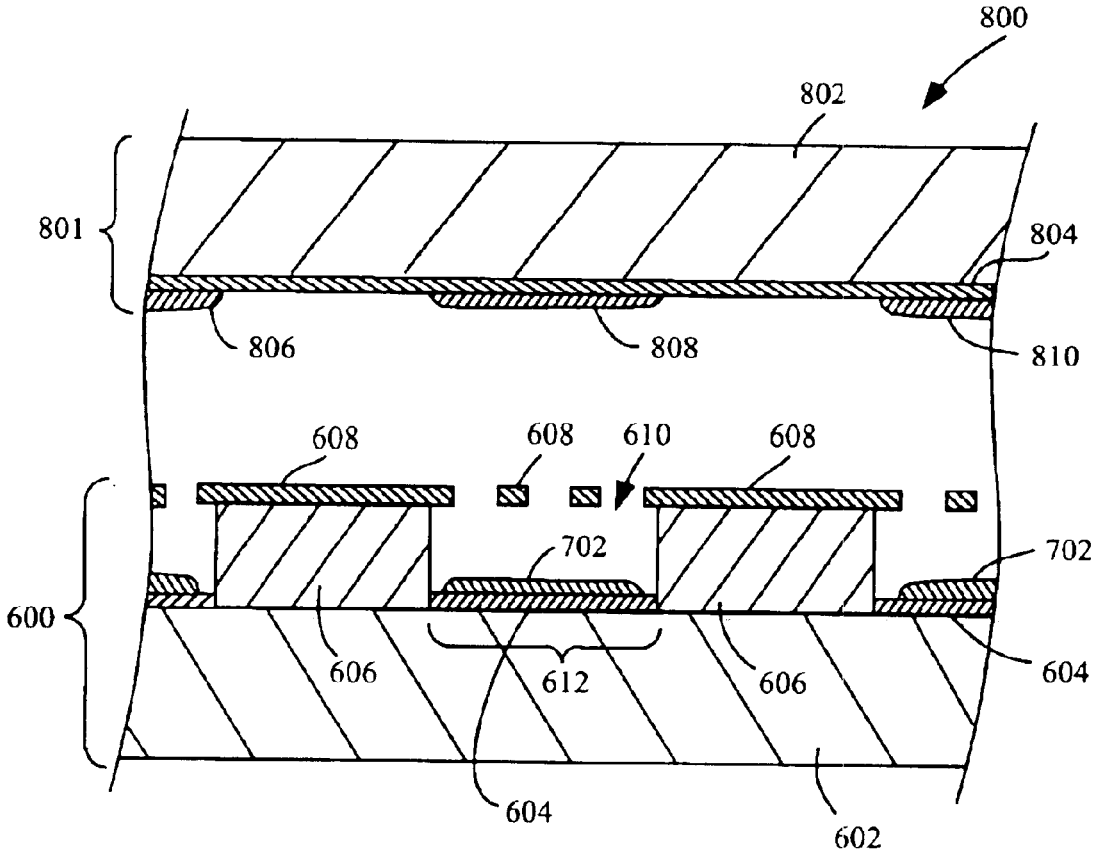
FIG. 8 is a cross sectional view of an FED using the electron emitting structure of FIGS. 6–7 and including an anode plate.

As illustrated in the cross-sectional view of FIG. 8, the electron emitting structure 600 is implemented as a cathode plate of a field emission display 800 (referred to hereinafter as FED 800). An anode plate 801 is maintained a small and substantially uniform distance above the electron emitting structure 600 across the dimensions of the display. The anode plate 801 includes a transparent substrate 802, e.g., a glass substrate. The substrate 802 includes a thin anode material 804 that phosphor material is deposited thereon, e.g., phosphors 806 (e.g., red), 808 (e.g., green) and 810 (e.g., blue). Preferably, the phosphors 806, 808 and 810 extend linearly about the substrate 802 and run parallel to and directly above the base electrodes 604. This gives the FED 800 a SONY® TRINITRON®-like appearance, i.e., the substrate 802 has solid lines of phosphor material (i.e., a striped anode) rather than dots of phosphor materials in a traditional pixelized FED. However, it is understood that the phosphors 806, 808 and 810 could be formed as lines running parallel to the gate electrodes 608, or alternatively, the phosphors could be formed as dots or spots rather than lines on the substrate 802 directly above each corresponding active region 612. It is also understood that the phosphor material may be directly deposited on the substrate 802 with a thin anode material coating formed thereover. It is noted that a suitable non-transmissive or opaque (black) substance may be applied to the transparent substrate 802 in between phosphors.

In operation, by selectively applying a voltage potential to a respective base electrode 604 and a respective gate electrode 608, the emitter material 702 deposited on a respective active region 612 (i.e., a cathode sub-pixel region) will emit electrons toward and illuminate a corresponding portion (i.e., an anode sub-pixel region) of a corresponding phosphor, e.g., phosphor 808, formed on the anode plate 802 above. Portions of the electron emission pass through the openings 610 formed in the gate electrode 608 crossing thereover, while other portions of the emission are blocked by the gate electrode 608 (see FIG. 13). Furthermore, as is similarly done in conventional FEDs, in order to accelerate the electron emission toward the phosphor material providing greater brightness of the illuminated anode sub-pixel region of phosphor, a potential is also applied to the anode material 804.

According to preferred embodiments, since the electric field produced is substantially uniform across the majority of the active region 612 and the resulting electron emission passing through the openings 610 is generally straight up with virtually no dispersion, the phosphors may be sized to more closely match the size of the active region 612. For example, in many conventional FEDs, the spread of an electron emission is not focused, but rather the corresponding phosphor is made larger than the area covered by the emitters forming the cathode sub-pixel, such that all of the spread electrons strike the desired phosphor. Advantageously, since the electron emission according to several embodiments is substantially straight up, the phosphor material does not have to be oversized without using additional focusing electrodes.

Furthermore, the FED 800 incorporates spacers (not shown) that will prevent the anode plate 801 from collapsing on the electron emitting structure 600 in the vacuum. These spacers may be implemented as one or more thin wall segments (e.g., having an aspect ratio of 10–50×1000 μm) evenly spaced across the substrate. For example, wall-like or rib-like spacers are preferably periodically formed in between active regions 612, e.g., on the insulating members 606, across the gate electrodes 608 above the insulating members 606, etc. Preferably, the spacers are located at a desired spacing across the display, e.g., for a 5-inch display, one spacer every 25 mm. Additionally, spacers are preferably located in between pixels (a grouping of three active (sub-pixel) regions, e.g., red, green and blue). Alternatively, these spacers may be implemented as support pillars that are evenly spaced across the substrate 602.

According to preferred embodiments, in addressing and driving the cathode plate 600, a 20 volt difference between the base drive voltage $V_B$ applied to the base electrode 604 and the gate voltage $V_G$ applied to the gate electrode 608 generates an electric field in the active region 612 sufficient to create an electron emission. For example, in preferred embodiments, a voltage potential of −10 volts is selectively applied to a respective base electrode, where an un-energized state of the base electrode is at 0 volts. At the same time, a voltage potential of +10 volts is applied to the respective gate electrode crossing over the respective base electrode 604, and where an un-energized state of the gate electrode 608 is at 0 volts. Thus, at different active regions 612 of the electron emitting structure 600 (see also FIG. 16), there is a voltage difference of either 0 volts (0 volts at the base and gate), 10 volts (i.e., −10 volts at the base and 0 volts at the gate, or 0 volts at the base and +10 volts at the gate) or 20 volts (−10 volts at the base and +10 volts at the gate) between the respective active region 612 and the gate electrode 608 crossing thereover. In preferred embodiments, the voltage difference of 20 volts provides an electric field sufficient to cause an electron emission from the emitter material 702 located on a given active region 612, whereas a voltage difference of 10 volts or 0 volts will not result in an electron emission. While the values herein are provided for example, it is understood that the voltage values may be other values or may be DC shifted, for example, the gate voltage may be +40 volts and the base electrode drive voltage may be +20 volts relative to +30 volts undriven.

Figure 9:
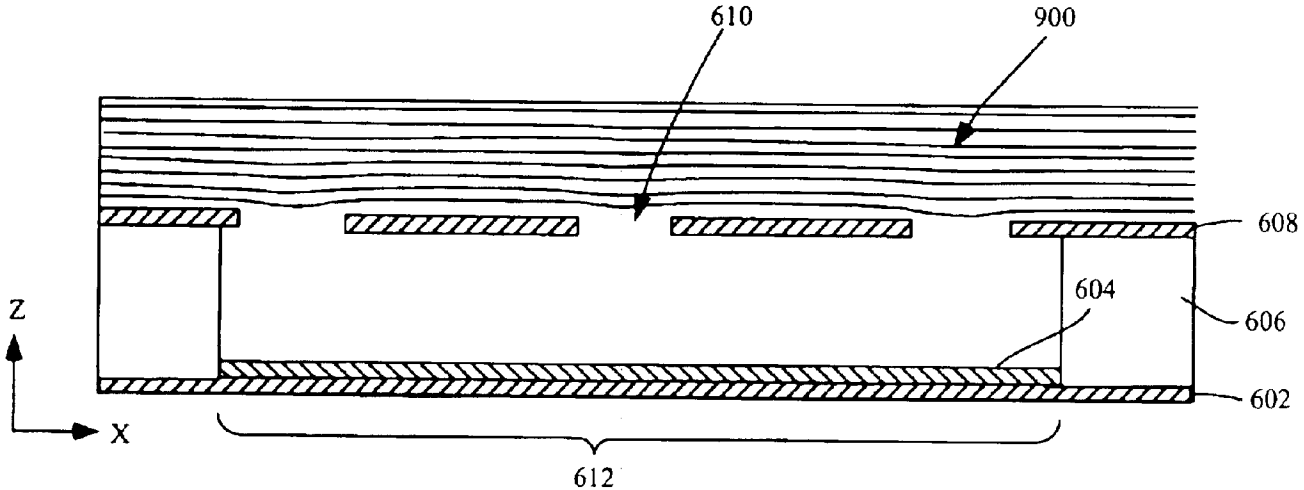
FIG. 9 is a diagram of the potential lines of the electric field across an active region of the base electrode when the active region is in an off state.

Referring next to FIGS. 9–12, the electric field produced is described in more detail. FIG. 9 illustrates the potential contour lines 900 generated above an active region 612 when the base electrode 604 (cathode of an FED) is off or in the "off-state", i.e., there is no electron emission from the active region. For example, the voltage difference between the base electrode 604 and corresponding gate electrode 608 is 0 volts. It is noted that for illustration purposes, the emitter material 702 is not illustrated in FIG. 9.

Figure 10:
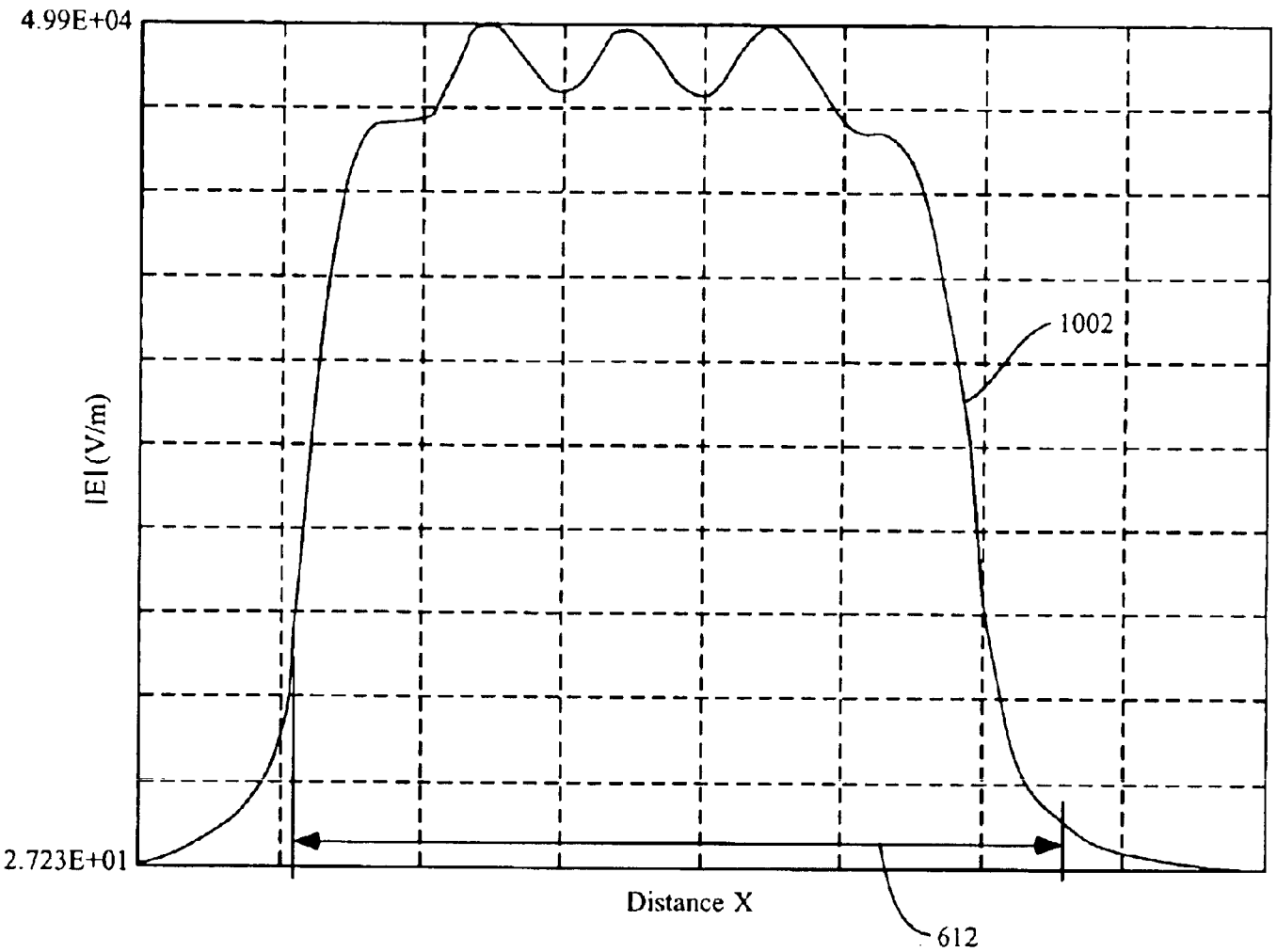
FIG. 10 is a graph of the electric field vs. distance across the active region taken at the surface of the active region in the off state of FIG. 9.

FIG. 10 is a plot of the electric field vs. distance across the active region 612 taken at the surface of the active region 612 in the off state of FIG. 9. According to several embodiments of the invention, an electron emission occurs when the electric field at the emitter material is greater than approximately 1.6 v/μm, e.g., 2.0 v/μm. That is, such an electric field sufficient to produce an electron emission is produced when the voltage difference between the base electrode 604 and the gate electrode 608 is about 20 volts. Accordingly, as seen in FIG. 10, the electric field 1002 is minimal (i.e., less than about 0.015 v/μm) at the edges of the active region 612 and peaks at approximately 0.0499 v/μm. Thus, even at its peak, the electric field is not sufficient to cause an electron emission from the emitter material located on the active region 612. It is noted that even though the voltage difference is 0 volts, the presence of potential lines is due primarily to the potential applied to the anode in an FED.

Figure 11:
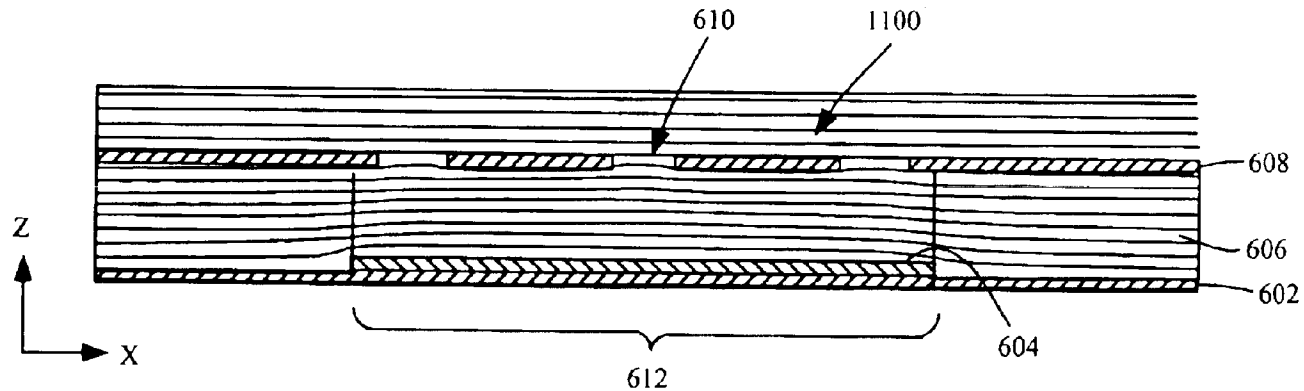
FIG. 11 is a diagram of the potential lines of the electric field across the active region when the active region is in an on state, illustrating a very uniform electric field across the active region.

FIG. 11 illustrates the potential contour lines 1100 generated above an active region 612 when the base electrode (cathode) is on or in the "on-state", i.e., there is an electron emission from the active region 612 caused by at least a 20 volt difference between the base electrode 604 and the gate electrode 608. It is noted that for illustration purposes, the emitter material 702 is not illustrated in FIG. 11. As illustrated, the potential lines 1100 are exceptionally uniform across the active region 612, particularly close to the surface of the base electrode 604. This is in contrast to the electric field or potential lines of known FED emitter in well structures in which the potential lines are designed to focus or peak upon the tip of a given emitter as shown in FIG. 2. The substantially uniform electric field yields an electron emission that is substantially straight up from the active region with very little dispersion (see FIGS. 13–15); thus, not requiring an additional focusing structure, e.g., no focusing electrode is required.

Figure 12:
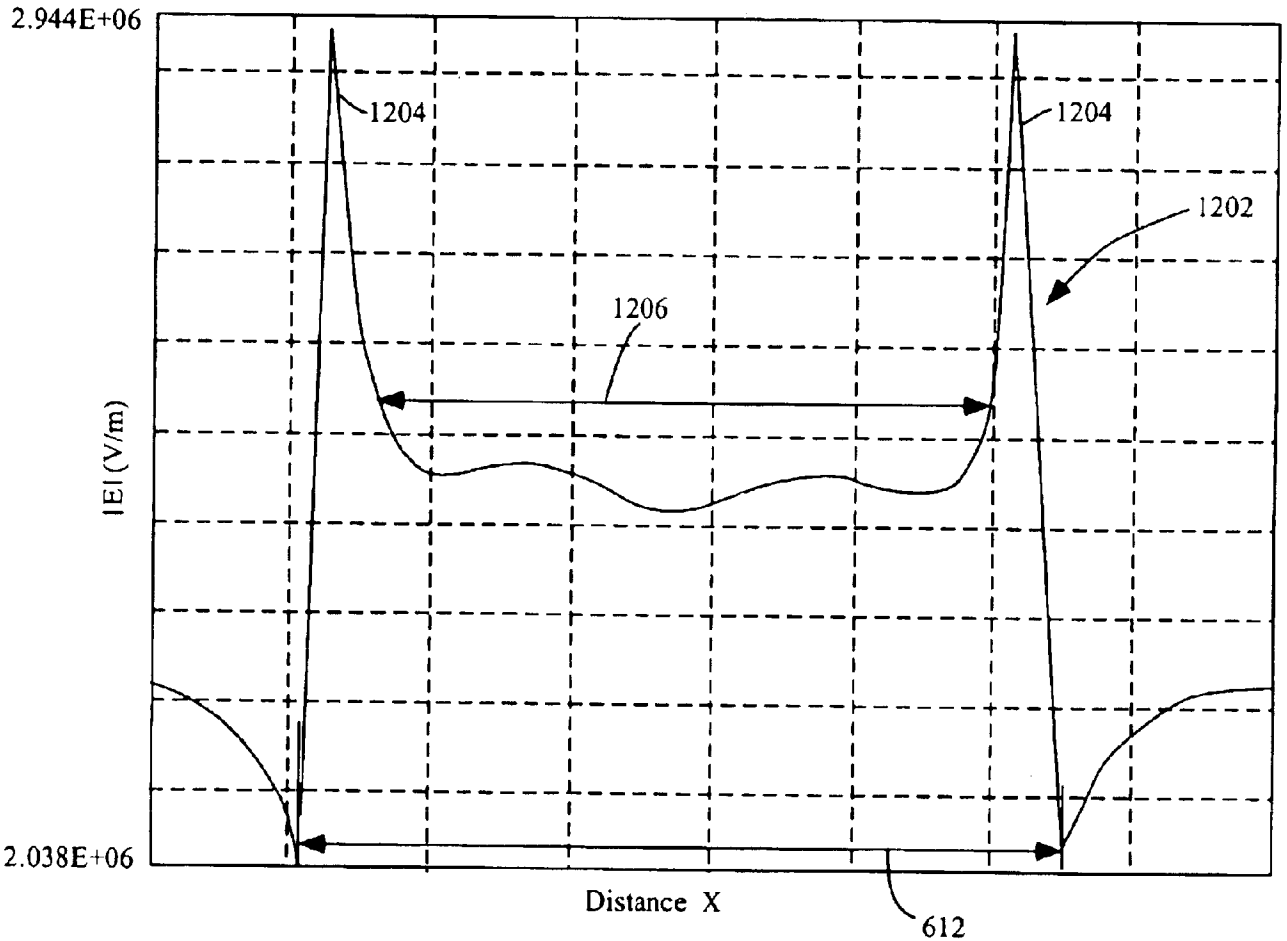
FIG. 12 is a graph of the electric field vs. distance across the active region taken at its surface in the on state of FIG. 10.

FIG. 12 is a plot of the electric field vs. distance across the active region 612 taken at the surface of the active region 612 in the on state of FIG. 11. According to several embodiments of the invention, an electron emission occurs when the electric field at the emitter material is greater than approximately 1.6 v/$\mu$m, e.g., 2.0 v/$\mu$m. Accordingly, as seen in FIG. 12, the electric field is minimally 2.038 v/$\mu$m at the edges of the active region 612, which is sufficient to cause an emission from an electron material 702 located at any portion of the active region 612.

Additionally, the electric field 1202 is substantially uniform across the active region 612, particularly across the middle 75% of the distance across the active region 612. For example, the electric field 1202 has a variation of only about 0.906 v/$\mu$m across the entire distance of the active region 612. However, the majority of the non-uniformity occurs proximate to the edge or periphery portions of the active region 612, which is seen as spikes 1204. Moving further toward the middle of the active region from the periphery edges, a middle region 1206 of the electric field 1202 is exceptionally uniform. Thus, across the middle 75% of the distance across the active region 612, the electric field has a variation of about 0.05 v/$\mu$m. Similarly, across the middle 80% of the distance across the active region 612, the electric field has a variation of about 0.1 v/$\mu$m. This is contrast to the electric field produced in known FEDs, which produce an electric field that is specifically designed to be non-uniform within an emitter well. For example, a known electric field is about 100 v/$\mu$m at the tip of the emitter (e.g., a Spindt tip) and a difference of about $10^6$ v/$\mu$m between the center and edge of the emitter well.

As such, in preferred embodiments and in general terms, the substantially uniform electric field may be defined having a variation of less than 1.0 v/$\mu$m (e.g., 0.906 v/$\mu$m) across the entire active region 612, more preferably having a variation of less than 0.5 v/$\mu$m (e.g., 0.1 v/$\mu$m) across the middle 80% of the distance across the entire active region 612, and most preferably having a variation of less than 0.1 v/$\mu$m (e.g., 0.05 v/$\mu$m) across the middle 75% of the distance across the entire active region 612.

Alternatively described, the electric field generated is substantially uniform over a relatively large distance across the active region 612. For example, the generated electric field at the surface of the active region 612 has a variation of less than 0.2 v/$\mu$m, more preferably, less than 0.15 v/$\mu$m across a distance of the active region 612 of at least 10 $\mu$m, more preferably, at least 20 $\mu$m, and most preferably, at least 30 $\mu$m.

Figure 13:
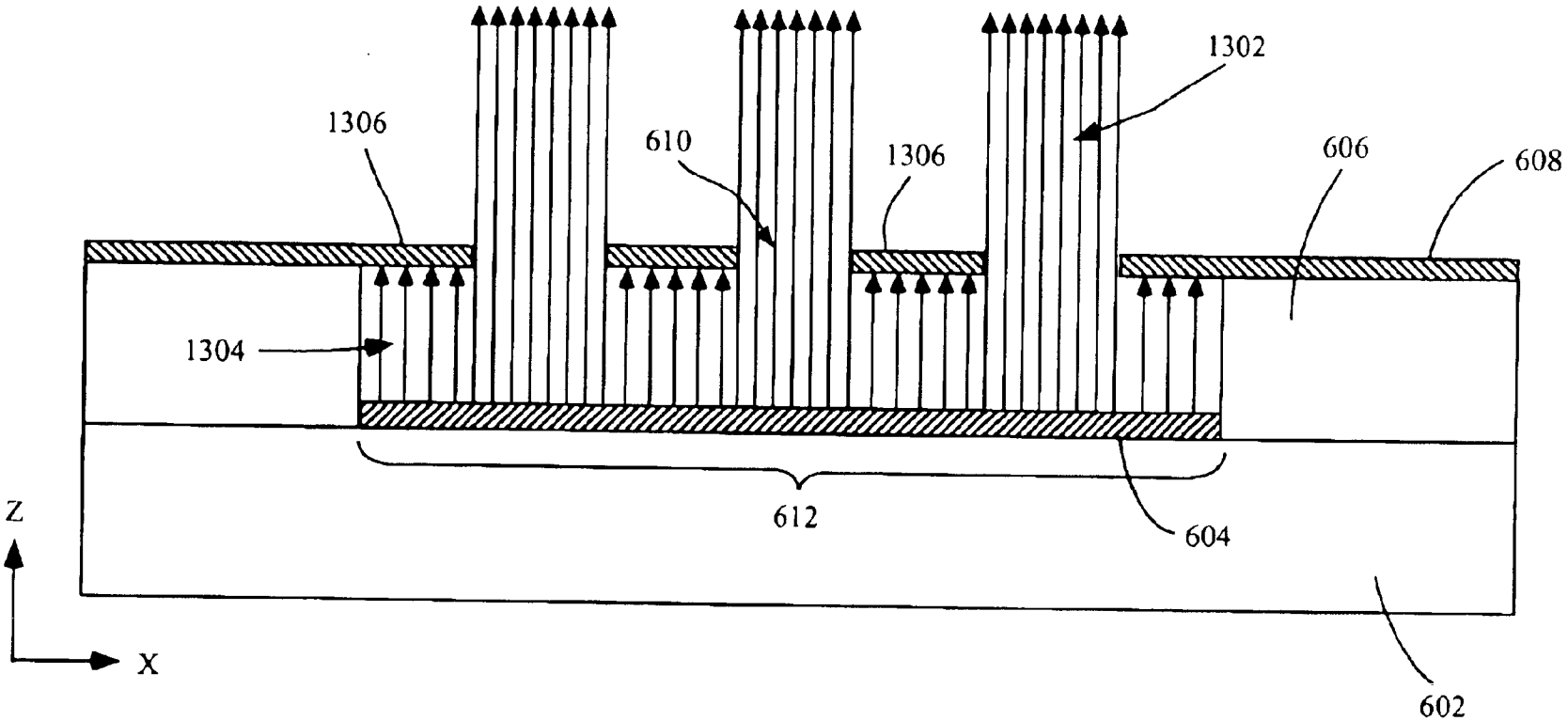
FIG. 13 is a diagram of a substantially straight the electron emission from the electron emitting structure in accordance with several embodiments.
Figure 14:
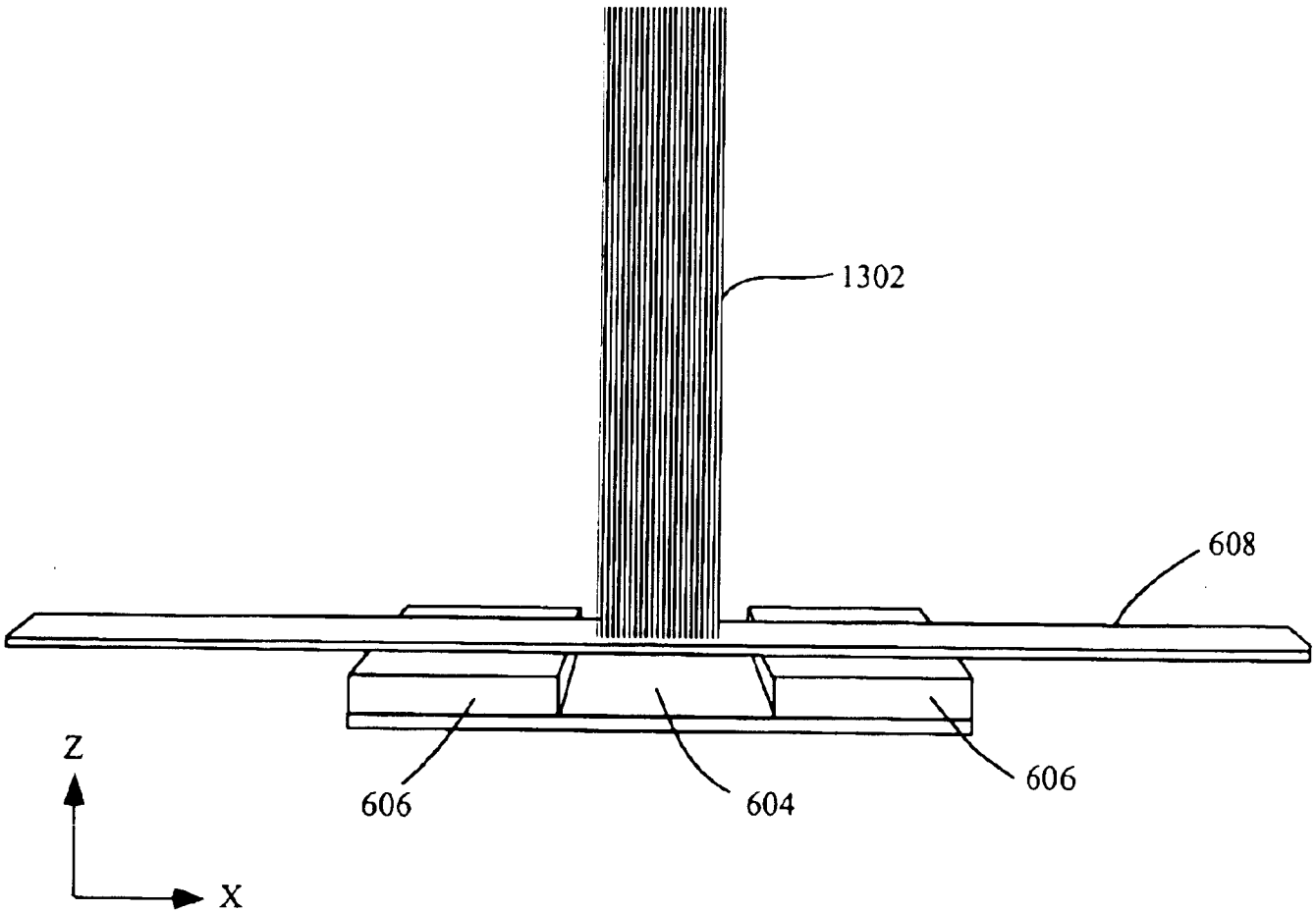
FIGS. 14 and 15 are diagrams of the electron trajectories of electron emission passing through a respective gate electrode of the emitting structure of FIG. 6 across the width and length, respectively, of the active region illustrating substantially no dispersion of the electron emission, primarily due to the substantially uniform electric field.
Figure 15:
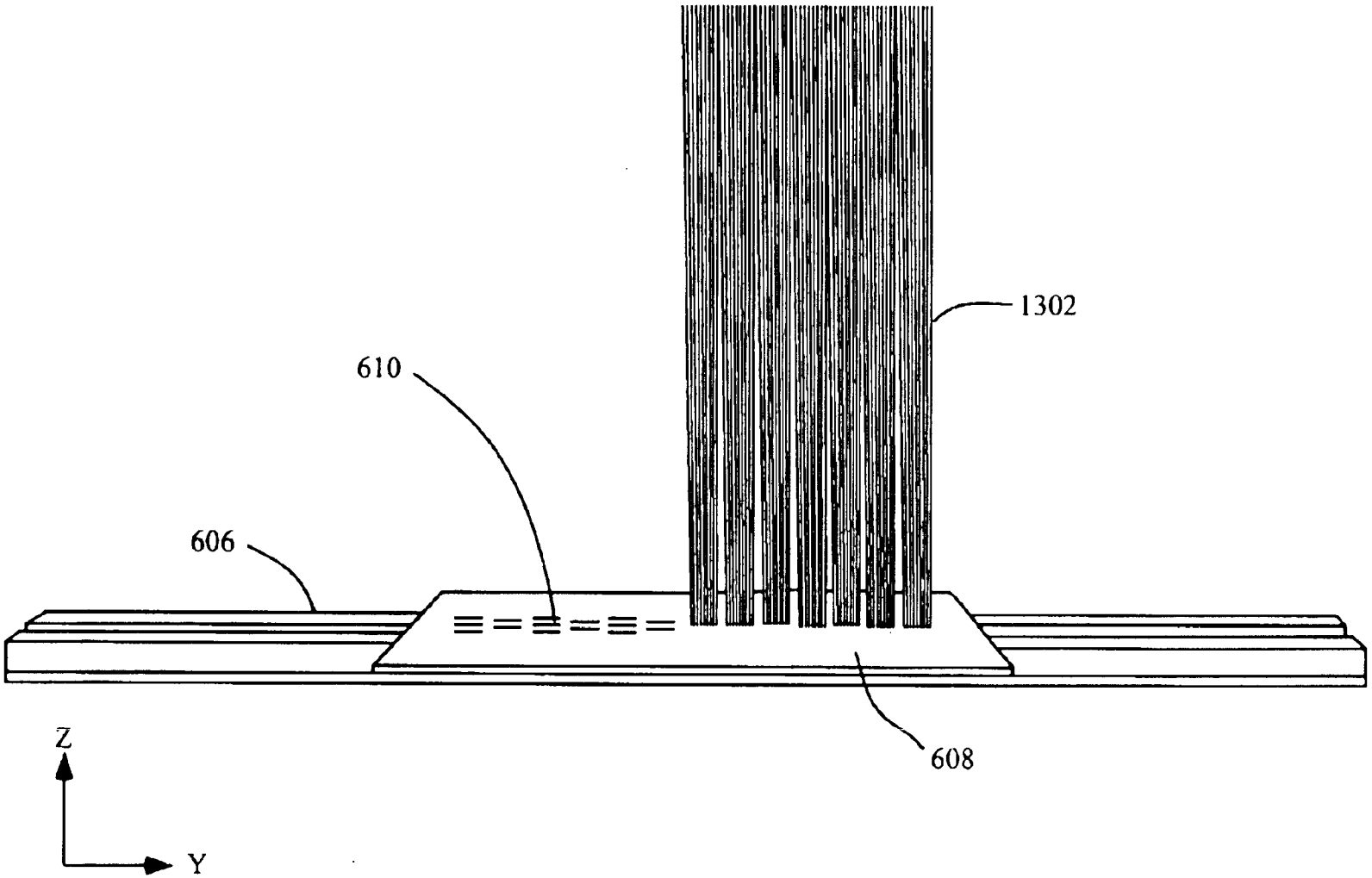

The substantially uniform electric field across the active region 612 provides for a substantially uniform and straight electron emission that does not require additional focusing (see FIGS. 13–15). Additionally, combined with an emitter material that easily emits electrons, the substantially uniform electric field allows for a lower drive voltage than in conventional FEDs, for example, in preferred embodiments, the drive voltages are 10 volts, i.e., 10 volts to the base electrodes 604 and 10 volts to the gate electrodes 608. In contrast, in order to create the electric field having the shape to sufficiently rip electrons off of the tip of a conventional emitter, a drive voltage of 20–100 volts is common.

It is noted that in many embodiments, the electron emitting material is deposited to substantially cover the active region 612. However, to produce an electron emission that is as uniform and straight as possible, it is desirable to pass the portions of the electron emission emitted from the most uniform portions of the electric field (e.g., the middle portion 1206) across the active region 612. Thus, in preferred embodiments, the openings 610 are formed or aligned in a central portion of the gate electrode 608 in order to avoid the majority of the non-uniformity in the electric field (e.g., at spikes 1204) at the edges of the active region as illustrated in FIG. 12. Thus, openings 610 of the gate electrodes 608 are preferably not formed or aligned above the periphery portions of the active region 612. For example, the openings 610 preferably correspond to the middle 80% of the distance across the active region 612 in FIG. 12. For example, the openings are formed and aligned to cover the middle 50–80%, more preferably the middle 60–75%, and most preferably the middle 70–75% of the active region 612. It is noted that the emitter material, however, may be patterned across the entire active region if desired, since electrons emitted from the emitting material at the periphery of the active region 612 (i.e., the less uniform portions, although still considerably more uniform than in traditional FEDs) are blocked or intercepted by the gate electrode 608. It is also understood that the emitting material may also be deposited within a central or middle portion of the active region 612 if desired.

FIG. 13 illustrates a substantially straight electron emission in accordance with several embodiments. The emission (illustrated as arrows extending up from the active region 612 of the base electrode 604) includes portions 1302 that pass through respective openings 610 and portions 1304 that are blocked or intercepted by portions 1306 of the gate electrode 608. As illustrated, the openings 610 function to allow portions 1302 of the emission to pass therethrough, while at the same time aperturing the emission. It is noted that since the region underneath the blocking portions 1306 of the gate electrode 608 is not taken up by an insulating material, the base electrode 604 and the gate electrode 608 produce a parallel plate-like electric field that is substantially uniform across the majority of the active region. Advantageously, this results in the illustrated substantially straight emission.

FIGS. 14 and 15 illustrates the electron trajectories of the electron emission 1302 produced by the electron emitting structure 600 of FIG. 6 across the width (x-direction) and the length (y-direction), respectively of the active region 612. As clearly seen, the electron emission 1302 has substantially no dispersion due to the substantially uniform electric field across the active region, i.e., the electron emission from the active region projects substantially straight through the openings 610 of the gate electrode 608 toward a corresponding anode sub-pixel region (phosphor) of the anode plate 801 thereabove. Thus, additional focusing structures are not required. This is a departure from known FEDs, which use separate focusing grids (see the focusing electrode 304 of FIG. 3) that are distinct from the conventional gate electrode.

Additionally, according to several embodiments of the invention, an electron emitting structure in accordance with several embodiments reduces the problem of crosstalk in an FED. For example, crosstalk occurs when electrons are unintentionally emitted from active regions (sub-pixels) adjacent to active regions (sub-pixels) that are intended to emit electrons. In an FED, crosstalk leads to a poor contrast ratio in the resulting display.

Figure 16:
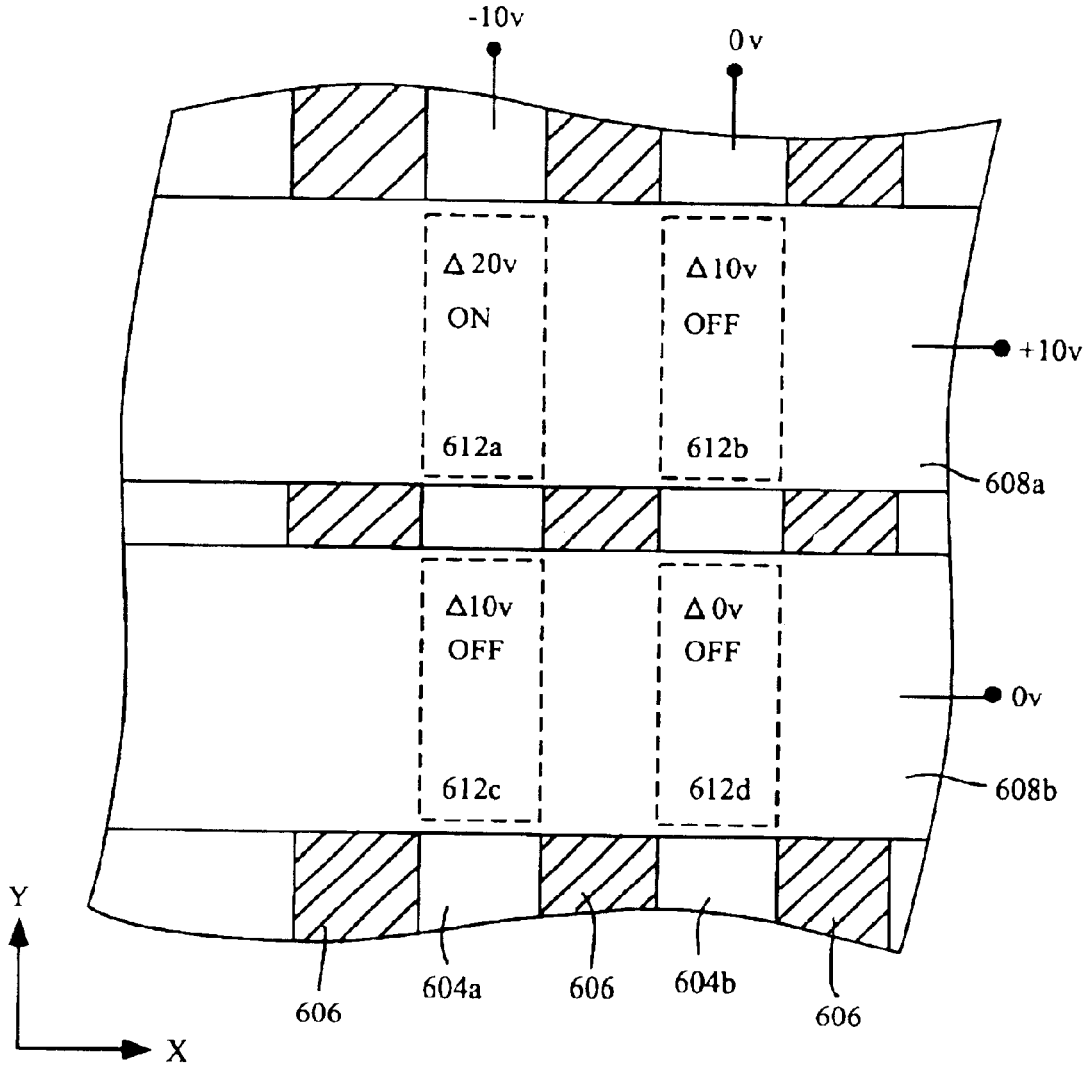
FIG. 16 is a diagram illustrating the driving of a given active region and its effect on adjacent active regions according to one embodiment of the invention.

As illustrated in FIG. 16 and according to one embodiment, a voltage differential of about 20 volts between a given base electrode 604 and a given gate electrode 608 is required to fully turn on an active region 612 (e.g., a sub-pixel region of an FED). Thus, in one embodiment, the base electrode drive voltage $V_B$ and the gate electrode drive voltage $V_G$ are each set to 10 volts (having opposite polarity). A threshold voltage $V_{TH}$ is set at 10 volts, such that above a 10 volt difference between the base electrode and the gate electrode, electrons may be emitted from an emitter material located at a given active region, i.e., if the voltage difference is greater than 10 volts, then the electric field at the emitter material may be greater than 2.0 volts/micron. However, it is noted that while a difference of 10 volts may cause a partial electron emission, it is not enough to fully turn on the given active region. Furthermore, the crosstalk voltage $V_{CT}$ is at 10 volts, such that crosstalk may occur if the voltage differential at an adjacent active region is greater than 10 volts.

As seen in the example of FIG. 16, if a given active region 612*a* is to be turned on, −10 volts is applied to base electrode 604*a* and +10 volts is applied to gate electrode 608*a*. It is noted that for clarity, the openings 610 are not illustrated in the gate electrodes 608 in FIG. 16. As seen, the voltage difference at active region 612*a* is 20 volts; thus, active region 612*a* is fully turned on (i.e., electrons are emitted from an emitter material located on the active region 612*a*). The voltage difference at adjacent active regions 612*b* and 612*c* is 10 volts; thus, these active regions 612*b* and 612*c* are off (i.e., no electrons are emitted). Likewise, the voltage difference at adjacent active region 612*d* is 0 volts; thus, active region 612*d* is off. Advantageously, since the threshold voltage is equal to the crosstalk voltage ($V_{TH}=V_{CT}=10$ volts), then the voltage difference at any adjacent active region is never enough to cause an electron emission; thus, crosstalk is not problematic according to many embodiments of the invention.

Next referring to FIG. 17, an alternative embodiment of the gate electrode of FIGS. 6–7 is illustrated in which the openings 610 formed therein extend throughout the entire gate electrode 1702. In this embodiment, since the openings cover the entire gate electrode, precise alignment of the gate electrode 1702 in the x-direction or the y-direction is not required, since a number of openings 610 will always be positioned above a given active region 612. However, in this alternative embodiment, the electron emitter material 702 is preferably patterned within a middle 50–80% of the active region 612 since it is likely that a particular opening will be formed over a periphery portion of the active region. As noted above, the electric field produced at the periphery portions is less uniform (e.g., see spikes 1204) than in the middle portions of the active region 612. Thus, in order to avoid potential spreading effects due to non-uniformity of the electric field at the active region periphery, electron emitter material is preferably not patterned on the periphery portions of the active region 612.

On the other hand, by patterning the openings 610 as illustrated in the gate electrode 608 of FIGS. 6 and 7, the entire active region 612 may be patterned with an emitter material. Thus, emission from the less uniform regions of the electric field in the active region are blocked by the gate electrode 608 thereabove. Generally, although more care is taken in aligning the gate electrode 608 over the active regions 612 than in aligning the gate electrode 1702, less care is taken in the depositing of electron emitter material 702 on the active region 612. It is also noted that although the electric field at the surface of the active region (as best illustrated in FIG. 12) is relatively less uniform than the middle regions of the active region 612, the electric field formed in accordance with several embodiments of the invention is considerably more uniform across the entire active region compared to the electric field generated within a traditional emitter in well design.

Figure 18:
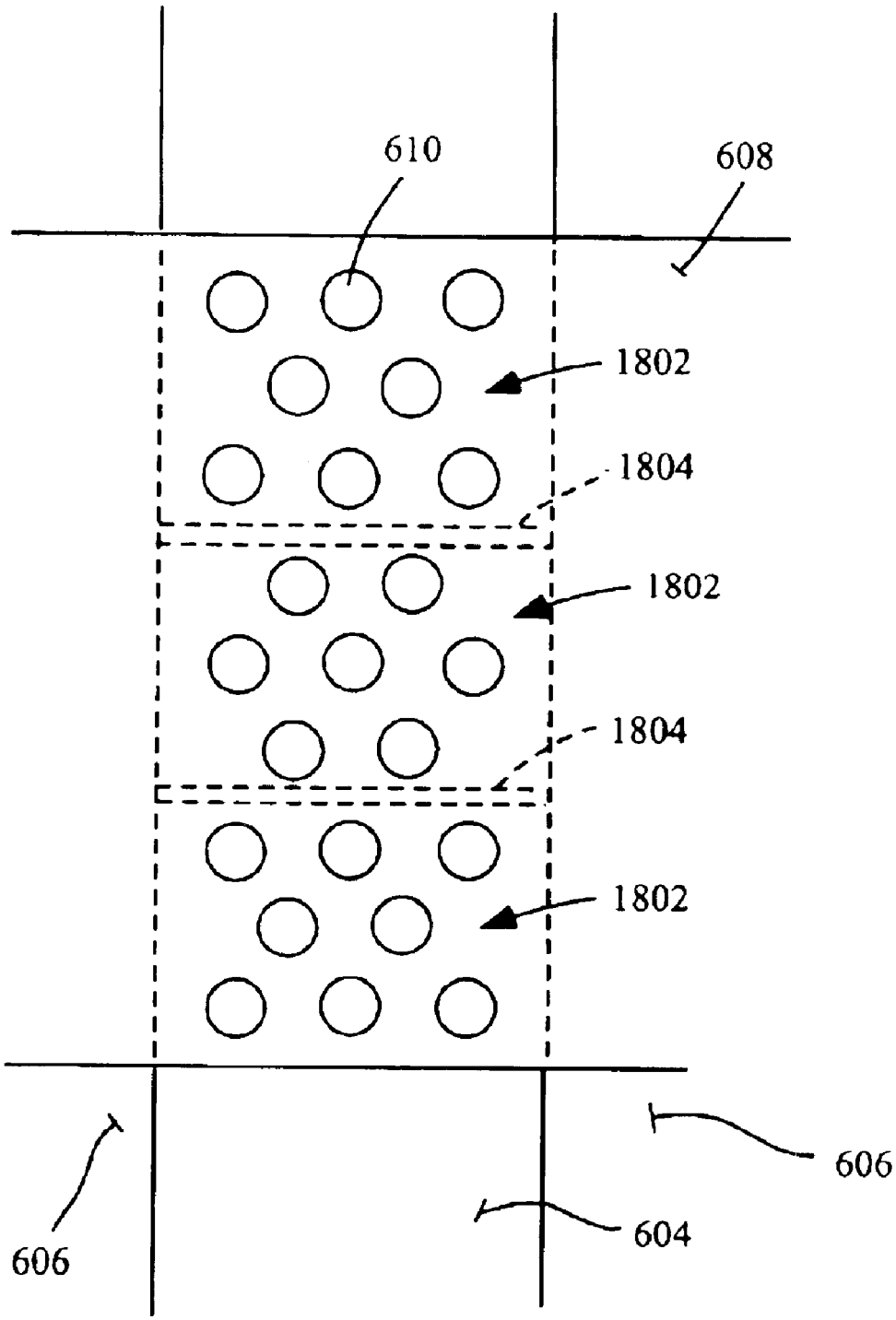
FIG. 18 is an alternative embodiment of the electron emitting structure of FIG. 6 in which the active regions are sub-divided by insulating material into smaller portions.

Referring next to FIG. 18, an alternative embodiment of the electron emitting structure of FIG. 6 is shown. In this embodiment, the active regions 612 are sub-divided by insulating material into smaller portions 1802. For example, one or more ribs 1804 of dielectric or insulating material extend over the active region 612 between opposite insulating members 606. Note that the insulating members 606 and the ribs 1804 are illustrated in dashed lines underneath the gate electrode 608. The ribs 1804 may be etched out of the dielectric layer prior to attaching a premade gate electrode, or may be etched out from underneath a gate electrode layer formed over the dielectric layer. Each active region 612 is still defined generally as the region of the base electrode 604 under a corresponding gate electrode 608 that electron emitting material may be located. The sub-divided portions 1802 of the active region are still large enough to allow one or more discrete electron emitting portions (e.g., tips, nanotubes, etc.) to be deposited thereon, the portions not separated from each other by dielectric material, or a continuously applied electron emitter material to be deposited thereon.

The additional ribs 1804 do not substantively affect the electric field produced within the active region or the resulting electron emission since there is not enough dielectric material present to cause the base electrode and the gate electrode to behave other than in a parallel plate arrangement. Thus, in some embodiments, additional dielectric material may be located in a variety of configurations between the active region 612 and the gate electrode 608; however, too much dielectric material may affect the uniformity of the electric field produced. For example, too much insulating material may reduce the parallel plate-like structure of the base and gate and result in a non-uniform electric field. The traditional emitter in well design represents an opposite extreme in which dielectric material occupies all of the space between the base electrode and the gate electrode other than where wells are formed. In the known emitter in well design, the base electrode and the gate electrode do not produce an electric field similar to that of a parallel plate, i.e., the electric field is non-uniform across the wells and focuses on the tip of an emitter cone (see FIG. 2).

As such, in the embodiment of FIG. 18, electron emitting material is deposited on portions of the active region 612, such that electrons emitted therefrom will be blocked by the gate electrode 608. At the same time, electron emitting material is deposited on portions of the active region 612, such that electrons emitted therefrom will pass through respective openings in the gate electrode 608.

In one implementation, the electron emitting structure 600 according to several embodiments of the invention is implemented as a cathode plate of an FED and is used to make a large FED type display, such as greater than 13 inches. Additionally, such a large FED cathode plate may be implemented in a spacerless FED, such as described in U.S. patent application Ser. No. 10/386,172, of Russ, et al., entitled SPACER-LESS FIELD EMISSION DISPLAY, filed concurrently herewith, and which is incorporated herein by reference.

In another alternative use, the electron emitting structure is used as a field ionizer, rather than an emitter. For example, as is known, the gate electrode drive voltage is made negative with respect to the base electrode drive voltage. Additionally, the electron emitting structures described herein may be implemented as field emission displays (FEDs) or any other application requiring an electron emission, such as an imaging device (X-ray device).

While the invention herein disclosed has been described by means of specific embodiments and applications thereof, numerous modifications and variations could be made thereto by those skilled in the art without departing from the scope of the invention set forth in the claims.

What is claimed is:

1. An electron emitting structure comprising:

a substrate;

a first electrode formed on the substrate;

a second electrode crossing over an active region of the first electrode;

an insulating material separating a portion of the first electrode and a portion of the second electrode and electrically insulating the first electrode from the second electrode;

a plurality of openings formed in at least a portion of the second electrode crossing over the active region; and an electron emitting material deposited on at least a portion of the active region of the first electrode, portions of the electron emitting material not underneath respective ones of the plurality of openings of the second electrode;

wherein a portion of the second electrode crossing over the active region is located to block a portion of an electron emission from the electron emitting material.

2. The structure of claim 1 wherein upon applying a first voltage potential to the first electrode and applying a second voltage potential to the second electrode, an electric field is produced in the active region sufficient to cause the electron emission from the electron emitting material.

3. The structure of claim 2 wherein portions of the electron emission pass trough respective ones of the plurality of openings and portions of the electron emission are blocked by portions of the second electrode.

4. The structure of claim 2 wherein each of the plurality of openings function to allow portions of the electric emission to pass therethrough and to aperture the electron emission.

5. The structure of claim 2 wherein the electric field is substantially uniform across the active region.

6. The structure of claim 5 wherein the electron emission is substantially straight up from the active region without requiring the use of a focusing structure to collimate the electron emission.

7. The structure of claim 5 wherein a variation of the electric field at a surface of the active region across the active region is less than 1.0 v/$\mu$m.

8. The structure of claim 5 wherein a variation of the electric field at a surface of the active region is less than 0.5 v/$\mu$m across a middle 80% of the active region.

9. The structure of claim 5 wherein a variation of the electric field at a surface of the active region is less than 0.1 v/$\mu$m across a middle 75% of the active region.

10. The structure of claim 5 wherein a variation of the electric field at a surface of the active region is less than 0.2 v/$\mu$m across a distance of at least 10 $\mu$m across the active region.

11. The structure of claim 1 wherein the electron emitting material comprises a plurality of electron emitting portions deposited on at least a portion of the active region, such that at least one electron emitting portion is aligned underneath a respective opening of the second electrode.

12. The structure of claim 11 wherein individual ones of the plurality of the electron emitter portions are not separated on the surface of the active region from each other by an insulating material.

13. The structure of claim 1 wherein the electron emitting material comprises a continuous electron emitting material deposited as a layer or film on at least a portion of the active region.

14. The structure of claim 1 wherein the second electrode comprises a layer of conductive material formed over the insulating material and etched to form the second electrode.

15. The structure of claim 1 wherein the first electrode and the insulating material comprise etched layers formed over the substrate; and wherein the second electrode comprises a discrete electrode separately manufactured and positioned over the first electrode and the insulating material such that the second electrode contacts the insulating material.

16. The structure of claim 1 wherein the electron emitting material is not deposited at periphery portions of the active region.

17. The structure of claim 1 wherein the insulating material is not formed in between the active region and edges of the plurality of openings farmed In the portion of the second electrode crossing over the active region.

18. The structure of claim 1 wherein the insulating material comprises linear insulating members extending on opposite sides of the first electrode.

19. A method of electron emission comprising:

applying a first potential to a first electrode formed on a substrate of art electron emitting structure;

applying a second potential to a second electrode crossing over an active region of the first electrode, the second electrode electrically insulated from the first electrode, the first electrode and the second electrode separated and electrically insulated from each other, wherein a plurality of openings are formed in at least a portion of the second electrode that crosses over the active region;

producing an electric field across the active region as a result of the applying the first potential and the applying the second potential; and causing, as a result of the producing step, an electron emission from an electron emitting material located on the active region, wherein portions of the electron emission pass through respective ones of the plurality of openings and portions of the electron emission are blocked by the second electrode.

20. The method of claim 19 wherein the producing comprises producing the electric field, the electric field being substantially uniform across the active region.

21. The method of claim 20 wherein the causing comprises causing the electron emission, wherein die electron emission is substantially straight up from the active region without requiring the use of a focusing structure to collimate the electron emission

22. The method of claim 20 wherein the producing comprises producing the electric field, wherein a variation of the electric field at a surface of the active region across the active region is less than 10 v/$\mu$m.

23. The method of claim 20 wherein the producing comprises producing the electric field, wherein a variation of the electric field at a surface of the active region is less than 0.5 v/$\mu$m across a middle 80% of the active region.

24. The method of claim 20 wherein the producing comprises producing the electric field, wherein a variation of the electric field at a surface of the active region is less than 0.1 v/$\mu$m across a middle 75% of the active region.

25. The method of claim 20 wherein the producing comprises producing the electric field, wherein a variation of the electric field at a surface of the active region is less than 0.2 v/$\mu$m across a distance of at least 10 $\mu$m across the active region.

26. A field emission display comprising;

a cathode plate comprising:

a substrate;

base electrodes formed on the substrate, the base electrodes functioning as cathodes;

gate electrodes crossing over the base electrodes, wherein each gate electrode crosses over an active sub-pixel region of each base electrode;

an insulating material separating portions of the base electrodes and portions of the gate electrodes and electrically insulating the base electrodes from the gate electrodes;

a plurality of openings formed in at least a portion of each gate electrode crossing over a respective active sub-pixel region of a respective base electrode; and an electron emitting material deposited on at least a portion of the active sub-pixel regions of the base electrodes, portions of the electric emitting material not underneath respective ones of the plurality of openings of the gate electrodes;

wherein a portion of each gate electrode crossing over the active sub-pixel region of each base electrode is located to block a portion of an electron emission from the electron emitting material; and an anode plate comprising:

a transparent substrate separated above the substrate; and phosphor material coupled to the transparent substrate, portions of the phosphor material corresponding to active sub-pixel regions of the base electrodes.

27. The display of claim 26 wherein upon applying a first voltage potential to a respective base electrode and applying a second voltage potential to a respective gate electrode, an electric field is produced in a respective active sub-pixel region sufficient to cause the electron emission from the electron emitting material deposited on the respective active sub-pixel region.

28. The display of claim 27 wherein portions of the electron emission pass through respective ones of the plurality of openings and portions of the electron emission are blocked by portions of the respective gate electrode.

29. The display of claim 27 wherein the electric field is substantially uniform across the respective active sub-pixel region.

30. The display of claim 26 wherein the insulating material is not formed in between the active sub-pixel regions and edges of the plurality of openings formed in the portion of the gate electrodes crossing over the active sub-pixel regions.

31. The display of claim 26 wherein the insulating material comprises linear insulating members extending in between adjacent base electrodes.

* * * * *

UNITED STATES PATENT AND TRADEMARK OFFICE

CERTIFICATE OF CORRECTION

PATENT NO. : 6,873,118 B2
DATED : March 29, 2005
INVENTOR(S) : Russ et al.

It is certified that error appears in the above-identified patent and that said Letters Patent is hereby corrected as shown below:

Title page,
Item [56], References Cited, U.S. PATENT DOCUMENTS, please delete "Chason" and insert -- Chasen --.

Column 17,
Line 55, delete "trough" and insert -- through --.
Line 59, delete "function" and insert -- functions --.

Column 18,
Line 41, delete "farmed In" and insert -- formed in --.
Line 48, delete "art" and insert -- an --.

Column 19,
Line 2, delete "die" and insert -- the --.
Line 9, delete "10 v/$\mu$m" and insert -- 1.0 v/$\mu$m --.
Line 23, delete ";" and insert -- : --.

Signed and Sealed this

Sixth Day of December, 2005

JON W. DUDAS
*Director of the United States Patent and Trademark Office*